US009088858B2

(12) United States Patent
Kraemer et al.

(10) Patent No.: US 9,088,858 B2
(45) Date of Patent: Jul. 21, 2015

(54) IMMERSIVE AUDIO RENDERING SYSTEM

(75) Inventors: Alan D. Kraemer, Tustin, CA (US); James Tracey, Laguna Niguel, CA (US); Themis Katsianos, Highland, CA (US)

(73) Assignee: DTS LLC, Calabasas, CA (US)

( * ) Notice: Subject to any disclaimer, the term of this patent is extended or adjusted under 35 U.S.C. 154(b) by 0 days.

(21) Appl. No.: 13/342,743

(22) Filed: Jan. 3, 2012

(65) Prior Publication Data

US 2012/0170756 A1 Jul. 5, 2012

Related U.S. Application Data

(60) Provisional application No. 61/429,600, filed on Jan. 4, 2011.

(51) Int. Cl.
*H04S 7/00* (2006.01)

(52) U.S. Cl.
CPC ..... *H04S 7/302* (2013.01); *H04S 2420/01* (2013.01)

(58) Field of Classification Search
CPC ..... H04S 3/002; H04S 3/00; H04S 3/04; H04S 1/002; H04S 7/30; H04S 2420/01; H04S 2400/01; H04S 2499/13; H04S 7/302
USPC ..... 381/17, 18, 306, 307, 310, 303
See application file for complete search history.

(56) References Cited

U.S. PATENT DOCUMENTS 3,170,991 A 2/1965 Glasgal
3,229,038 A 1/1966 Richter
3,246,081 A 4/1966 Edwards
3,249,696 A 5/1966 Van Sickle
3,665,105 A 5/1972 Chowning
3,697,692 A 10/1972 Hafler
3,725,586 A 4/1973 Iida
3,745,254 A 7/1973 Ohta et al.
3,757,047 A 9/1973 Ito et al.
3,761,631 A 9/1973 Ito et al.

(Continued)

FOREIGN PATENT DOCUMENTS

DE 33 31 352 A1 3/1985
EP 0 097 982 A3 1/1984

(Continued)

OTHER PUBLICATIONS

International Search Report and Written Opinion issued in application No. PCT/US2012/020102 on May 1, 2012.

(Continued)

*Primary Examiner* — Ping Lee
(74) *Attorney, Agent, or Firm* — Knobbe Martens Olson & Bear LLP

(57) ABSTRACT

A depth processing system can employ stereo speakers to achieve immersive effects. The depth processing system can advantageously manipulate phase and/or amplitude information to render audio along a listener's median plane, thereby rendering audio along varying depths. In one embodiment, the depth processing system analyzes left and right stereo input signals to infer depth, which may change over time. The depth processing system can then vary the phase and/or amplitude decorrelation between the audio signals over time to enhance the sense of depth already present in the audio signals, thereby creating an immersive depth effect.

23 Claims, 24 Drawing Sheets

(56) References Cited

U.S. PATENT DOCUMENTS

| | | | | |
|---|---|---|---|---|
| 3,772,479 | A | 11/1973 | Hilbert | |
| 3,849,600 | A | 11/1974 | Ohshima | |
| 3,885,101 | A | 5/1975 | Ito et al. | |
| 3,892,624 | A | 7/1975 | Shimada | |
| 3,925,615 | A | 12/1975 | Nakano | |
| 3,943,293 | A | 3/1976 | Bailey | |
| 4,024,344 | A | 5/1977 | Dolby et al. | |
| 4,063,034 | A | 12/1977 | Peters | |
| 4,069,394 | A | 1/1978 | Doi et al. | |
| 4,118,599 | A | 10/1978 | Iwahara | |
| 4,139,728 | A | 2/1979 | Haramoto et al. | |
| 4,192,969 | A | 3/1980 | Iwahara | |
| 4,204,092 | A | 5/1980 | Bruney | |
| 4,209,665 | A | 6/1980 | Iwahara | |
| 4,218,583 | A | 8/1980 | Poulo | |
| 4,218,585 | A | 8/1980 | Carver | |
| 4,219,696 | A | 8/1980 | Kogure et al. | |
| 4,237,343 | A | 12/1980 | Kurtin et al. | |
| 4,239,937 | A | 12/1980 | Kampmann | |
| 4,303,800 | A | 12/1981 | DeFreitas | |
| 4,308,423 | A | 12/1981 | Cohen | |
| 4,308,424 | A | 12/1981 | Bice, Jr | |
| 4,309,570 | A | 1/1982 | Carver | |
| 4,332,979 | A | 6/1982 | Fischer | |
| 4,349,698 | A | 9/1982 | Iwahara | |
| 4,355,203 | A | 10/1982 | Cohen | |
| 4,356,349 | A | 10/1982 | Robinson | |
| 4,393,270 | A | 7/1983 | van den Berg | |
| 4,394,536 | A | 7/1983 | Shima et al. | |
| 4,408,095 | A | 10/1983 | Ariga et al. | |
| 4,479,235 | A | 10/1984 | Griffis | |
| 4,489,432 | A | 12/1984 | Polk | |
| 4,495,637 | A | 1/1985 | Bruney | |
| 4,497,064 | A | 1/1985 | Polk | |
| 4,503,554 | A | 3/1985 | Davis | |
| 4,567,607 | A | 1/1986 | Bruney et al. | |
| 4,569,074 | A | 2/1986 | Polk | |
| 4,589,129 | A | 5/1986 | Blackmer et al. | |
| 4,594,610 | A | 6/1986 | Patel | |
| 4,594,729 | A | 6/1986 | Weingartner | |
| 4,594,730 | A | 6/1986 | Rosen | |
| 4,622,691 | A | 11/1986 | Tokumo et al. | |
| 4,648,117 | A | 3/1987 | Kunugi et al. | |
| 4,696,036 | A | 9/1987 | Julstrom | |
| 4,703,502 | A | 10/1987 | Kasai et al. | |
| 4,748,669 | A * | 5/1988 | Klayman | 381/1 |
| 4,856,064 | A | 8/1989 | Iwamatsu | |
| 4,862,502 | A | 8/1989 | Griesinger | |
| 4,866,774 | A | 9/1989 | Klayman | |
| 4,866,776 | A | 9/1989 | Kasai et al. | |
| 4,888,809 | A | 12/1989 | Knibbeler | |
| 4,933,768 | A | 6/1990 | Ishikawa et al. | |
| 4,953,213 | A | 8/1990 | Tasaki et al. | |
| 5,033,092 | A | 7/1991 | Sadaie | |
| 5,034,983 | A | 7/1991 | Cooper et al. | |
| 5,046,097 | A | 9/1991 | Lowe et al. | |
| 5,105,462 | A | 4/1992 | Lowe et al. | |
| 5,146,507 | A | 9/1992 | Satoh et al. | |
| 5,199,075 | A | 3/1993 | Fosgate | |
| 5,208,860 | A | 5/1993 | Lowe et al. | |
| 5,228,085 | A | 7/1993 | Aylward | |
| 5,251,260 | A | 10/1993 | Gates | |
| 5,255,326 | A | 10/1993 | Stevenson | |
| 5,319,713 | A | 6/1994 | Waller, Jr. et al. | |
| 5,325,435 | A | 6/1994 | Date et al. | |
| 5,333,200 | A | 7/1994 | Cooper et al. | |
| 5,371,799 | A | 12/1994 | Lowe et al. | |
| 5,400,405 | A | 3/1995 | Petroff | |
| 5,533,129 | A | 7/1996 | Gefvert | |
| 5,546,465 | A | 8/1996 | Kim | |
| 5,572,591 | A | 11/1996 | Numazu | |
| 5,579,396 | A | 11/1996 | Iida et al. | |
| 5,581,618 | A | 12/1996 | Satoshi et al. | |
| 5,666,425 | A | 9/1997 | Sibbald et al. | |
| 5,677,957 | A | 10/1997 | Hulsebus | |
| 5,734,724 | A | 3/1998 | Kinoshita | |
| 5,742,688 | A | 4/1998 | Ogawa | |
| 5,771,295 | A | 6/1998 | Waller | |
| 5,799,094 | A | 8/1998 | Mouri | |
| 5,896,456 | A * | 4/1999 | Desper | 381/1 |
| 5,912,976 | A | 6/1999 | Klayman et al. | |
| 5,970,152 | A | 10/1999 | Klayman et al. | |
| 6,009,178 | A | 12/1999 | Abel et al. | |
| 6,009,179 | A | 12/1999 | Wood et al. | |
| 6,111,958 | A * | 8/2000 | Maher | 381/17 |
| 6,236,730 | B1 | 5/2001 | Cowieson et al. | |
| 6,307,941 | B1 | 10/2001 | Tanner, Jr. et al. | |
| 6,424,719 | B1 | 7/2002 | Elko et al. | |
| 6,498,857 | B1 | 12/2002 | Sibbald | |
| 6,507,658 | B1 | 1/2003 | Abel et al. | |
| 6,577,736 | B1 | 6/2003 | Clemow | |
| 6,587,565 | B1 | 7/2003 | Choi | |
| 6,668,061 | B1 | 12/2003 | Abel | |
| 6,721,425 | B1 | 4/2004 | Aylward | |
| 6,931,134 | B1 | 8/2005 | Waller et al. | |
| 6,937,737 | B2 | 8/2005 | Polk, Jr. | |
| 7,072,474 | B2 | 7/2006 | Nelson et al. | |
| 7,076,071 | B2 | 7/2006 | Katz | |
| 7,167,567 | B1 | 1/2007 | Sibbald et al. | |
| 7,177,431 | B2 | 2/2007 | Davis et al. | |
| 7,200,236 | B1 | 4/2007 | Klayman et al. | |
| 7,490,044 | B2 | 2/2009 | Kulkarni | |
| 7,492,907 | B2 | 2/2009 | Klayman et al. | |
| 7,522,733 | B2 | 4/2009 | Kraemer et al. | |
| 7,536,017 | B2 | 5/2009 | Sakurai et al. | |
| 7,636,443 | B2 | 12/2009 | Klayman | |
| 7,778,427 | B2 | 8/2010 | Klayman | |
| 7,920,711 | B2 | 4/2011 | Takashima et al. | |
| 7,974,417 | B2 | 7/2011 | Kim et al. | |
| 7,974,425 | B2 | 7/2011 | Fincham | |
| 8,027,494 | B2 | 9/2011 | Kimura et al. | |
| 8,050,433 | B2 | 11/2011 | Kim | |
| 8,050,434 | B1 | 11/2011 | Kato et al. | |
| 8,116,468 | B2 | 2/2012 | Katayama | |
| 8,295,496 | B2 | 10/2012 | Kulkarni | |
| 8,335,330 | B2 | 12/2012 | Usher | |
| 8,472,631 | B2 | 6/2013 | Kraemer et al. | |
| 8,660,271 | B2 | 2/2014 | Wang et al. | |
| 2003/0031333 | A1 | 2/2003 | Cohen et al. | |
| 2003/0169886 | A1 | 9/2003 | Boyce | |
| 2005/0271214 | A1 | 12/2005 | Kim | |
| 2006/0008096 | A1 * | 1/2006 | Waller | 381/106 |
| 2006/0093152 | A1 | 5/2006 | Thompson et al. | |
| 2007/0025559 | A1 | 2/2007 | Mihelich et al. | |
| 2007/0025560 | A1 | 2/2007 | Asada | |
| 2007/0076892 | A1 | 4/2007 | Kim | |
| 2008/0008324 | A1 | 1/2008 | Sim et al. | |
| 2008/0019533 | A1 | 1/2008 | Noguchi et al. | |
| 2008/0247555 | A1 | 10/2008 | Avendano et al. | |
| 2009/0190766 | A1 * | 7/2009 | Klayman et al. | 381/18 |
| 2009/0268917 | A1 | 10/2009 | Croft, III | |
| 2010/0316224 | A1 | 12/2010 | Lau | |
| 2012/0076308 | A1 * | 3/2012 | Kuech et al. | 381/22 |
| 2012/0170757 | A1 | 7/2012 | Kraemer et al. | |
| 2012/0237037 | A1 | 9/2012 | Ninan et al. | |

FOREIGN PATENT DOCUMENTS

| | | | |
|---|---|---|---|
| EP | 0 312 406 | A2 | 4/1989 |
| EP | 0 320 270 | A2 | 6/1989 |
| EP | 0 367 569 | A2 | 10/1989 |
| EP | 0 354 517 | A2 | 2/1990 |
| EP | 0 357 402 | A2 | 3/1990 |
| EP | 0 526 880 | A2 | 2/1993 |
| EP | 0 637 191 | A2 | 2/1996 |
| EP | 0 699 012 | A2 | 2/1996 |
| FI | 35 014 | | 2/1966 |
| GB | 2 154 835 | A | 9/1985 |
| GB | 2 277 855 | A | 9/1994 |
| JP | 40-29936 | | 10/1940 |
| JP | 43-12585 | | 5/1943 |
| JP | 55152571 | | 11/1980 |
| JP | 58-144989 | | 9/1983 |
| JP | 59-27692 | | 2/1984 |

(56) References Cited

FOREIGN PATENT DOCUMENTS

| | | |
|---|---|---|
| JP | 61-33600 | 2/1986 |
| JP | 61-166696 | 10/1986 |
| JP | 06269097 | 9/1994 |
| WO | WO 87/06090 | 10/1987 |
| WO | WO 91/19407 | 12/1991 |
| WO | WO 94/16538 | 7/1994 |
| WO | WO 96/34509 | 10/1996 |

OTHER PUBLICATIONS

International Search Report and Written Opinion issued in application No. PCT/US2012/020099 on May 4, 2012.
Potard et al., "*Decorrelation Techniques for the Rendering of Apparent Sound Source Width in 3D Audio Displays", Proc. of the 7th* Int. Conference on Digital Audio Effects (DAFx'04), Naples, Italy, Oct. 5-8, 2004, pp. 28-284.
Kendall, "*The Decorrelation of Audio Signals and It's Impact on Spatial Imagery*", Computer Music Journal, 19(4):71-87 (1995).
Kurozumi, K. et al., "A New Sound Image Broadening Control System Using a Correlation Coefficient Variation Method", Electronics and Communications in Japan, vol. 67-A, No. 3, pp. 204-211, Mar. 1984.
Sundberg, J., "The Acoustics of the Singing Voice", The Physics of Music, pp. 16-23, 1978.
Schroeder, M.R., "An Artificial Stereophonic Effect Obtained from a Single Audio Signal", Journal of the Audio Engineering Society, vol. 6, No. 2, pp. 74-76, Apr. 1958.
Ishihara. M., "A New Analog Signal Processor for a Stereo Enhancement System", IEEE Transactions on Consumer Electronics, vol. 37, No. 4, pp. 806-813, Nov. 1991.
Allison, R., "The Loudspeaker/Living Room System", Audi, pp. 18-22, Nov. 1971.
Vaughan, D., "How We Hear Direction", Audio, pp. 51-55, Dec. 1983.
Stevens, S., et al., "Chapter 5: The Two-Eamed Man", Sound and Hearing, pp. 98-106 and 196, 1965.
Eargle, J., "Multichannel Stereo Matrix Systems; An Overview", Journal of the Audio Engineering Society, pp. 552-558.
Wilson, Kim "Ac-3 is Her! But Are You Ready to Pay the Price?", Home Theatre, pp. 60-65, Jun. 1995.
International Search Report Dated Mar. 10, 1998 From Corresponding PCT Application, PCT/US97/19825 3 pages.
Kaufman, Richard J., "Frequency Contouring for Image Enhancement", Audio, pp. 34-39, Feb. 1985.
English translation of Chinese Office Action in Chinese Application No. 2012800046625 dated Dec. 3, 2014 in 9 pages.

* cited by examiner

1000B

1000A

IMMERSIVE AUDIO RENDERING SYSTEM

RELATED APPLICATION

This application claims priority under 35 U.S.C. §119(e) to U.S. Provisional Application No. 61/429,600 filed Jan. 4, 2011, entitled "Immersive Audio Rendering System," the disclosure of which is hereby incorporated by reference in its entirety.

BACKGROUND

Increasing technical capabilities and user preferences have led to a wide variety of audio recording and playback systems. Audio systems have developed beyond the simpler stereo systems having separate left and right recording/playback channels to what are commonly referred to as surround sound systems. Surround sound systems are generally designed to provide a more realistic playback experience for the listener by providing sound sources that originate or appear to originate from a plurality of spatial locations arranged about the listener, generally including sound sources located behind the listener.

A surround sound system will frequently include a center channel, at least one left channel, and at least one right channel adapted to generate sound generally in front of the listener. Surround sound systems will also generally include at least one left surround source and at least one right surround source adapted for generation of sound generally behind the listener. Surround sound systems can also include a low frequency effects (LFE) channel, sometimes referred to as a subwoofer channel, to improve the playback of low frequency sounds. As one particular example, a surround sound system having a center channel, a left front channel, a right front channel, a left surround channel, a right surround channel, and an LFE channel can be referred to as a 5.1 surround system. The number 5 before the period indicates the number of non-bass speakers present and the number 1 after the period indicates the presence of a subwoofer.

SUMMARY

For purposes of summarizing the disclosure, certain aspects, advantages and novel features of the inventions have been described herein. It is to be understood that not necessarily all such advantages can be achieved in accordance with any particular embodiment of the inventions disclosed herein. Thus, the inventions disclosed herein can be embodied or carried out in a manner that achieves or optimizes one advantage or group of advantages as taught herein without necessarily achieving other advantages as can be taught or suggested herein.

In certain embodiments, a method of rendering depth in an audio output signal includes receiving a plurality of audio signals, identifying first depth steering information from the audio signals at a first time, and identifying subsequent depth steering information from the audio signals at a second time. In addition, the method can include decorrelating, by one or more processors, the plurality of audio signals by a first amount that depends at least partly on the first depth steering information to produce first decorrelated audio signals. The method may further include outputting the first decorrelated audio signals for playback to a listener. In addition, the method can include, subsequent to said outputting, decorrelating the plurality of audio signals by a second amount different from the first amount, where the second amount can depend at least partly on the subsequent depth steering information to produce second decorrelated audio signals. Moreover, the method can include outputting the second decorrelated audio signals for playback to the listener.

In other embodiments, a method of rendering depth in an audio output signal can include receiving a plurality of audio signals, identifying depth steering information that changes over time, decorrelating the plurality of audio signals dynamically over time, based at least partly on the depth steering information, to produce a plurality of decorrelated audio signals, and outputting the plurality of decorrelated audio signals for playback to a listener. At least said decorrelating or any other subset of the method can be implemented by electronic hardware.

A system for rendering depth in an audio output signal can include, in some embodiments: a depth estimator that can receive two or more audio signals and that can identify depth information associated with the two or more audio signals, and a depth renderer comprising one or more processors. The depth renderer can decorrelate the two or more audio signals dynamically over time based at least partly on the depth information to produce a plurality of decorrelated audio signals, and output the plurality of decorrelated audio signals (e.g., for playback to a listener and/or output to another audio processing component).

Various embodiments of a method of rendering depth in an audio output signal include receiving input audio having two or more audio signals, estimating depth information associated with the input audio, which depth information may change over time, and enhancing the audio dynamically based on the estimated depth information by one or more processors. This enhancing can vary dynamically based on variations in the depth information over time. Further, the method can include outputting the enhanced audio.

A system for rendering depth in an audio output signal can include, in several embodiments, a depth estimator that can receive input audio having two or more audio signals and that can estimate depth information associated with the input audio; and an enhancement component having one or more processors. The enhancement component can enhance the audio dynamically based on the estimated depth information. This enhancement can vary dynamically based on variations in the depth information over time.

In certain embodiments, a method of modulating a perspective enhancement applied to an audio signal includes receiving left and right audio signals, where the left and right audio signals each have information about a spatial position of a sound source relative to a listener. The method can also include calculating difference information in the left and right audio signals, applying at least one perspective filter to the difference information in the left and right audio signals to yield left and right output signals, and applying a gain to the left and right output signals. A value of this gain can be based at least in part on the calculated difference information. At least said applying the gain (or the entire method or a subset thereof) is performed by one or more processors.

In some embodiments, a system for modulating a perspective enhancement applied to an audio signal includes a signal analysis component that can analyze a plurality of audio signals by at least: receive left and right audio signals, where the left and right audio signals each have information about a spatial position of a sound source relative to a listener, and obtain a difference signal from the left and right audio signals. The system can also include a surround processor having one or more physical processors. The surround processor can apply at least one perspective filter to the difference signal to yield left and right output signals, where an output of the at least one perspective filter can be modulated based at least in part on the calculated difference information.

In certain embodiments, non-transitory physical computer storage having instructions stored therein can implement, in one or more processors, operations for modulating a perspective enhancement applied to an audio signal. These operations can include: receiving left and right audio signals, where the left and right audio signals each have information about a spatial position of a sound source relative to a listener, calculating difference information in the left and right audio signals, applying at least one perspective filter to each of the left and right audio signals to yield left and right output signals, and modulating said application of the at least one perspective filter based at least in part on the calculated difference information.

A system for modulating a perspective enhancement applied to an audio signal includes, in certain embodiments, means for receiving left and right audio signals, where the left and right audio signals each have information about a spatial position of a sound source relative to a listener, means for calculating difference information in the left and right audio signals, means for applying at least one perspective filter to each of the left and right audio signals to yield left and right output signals, and means for modulating said application of the at least one perspective filter based at least in part on the calculated difference information.

BRIEF DESCRIPTION OF THE DRAWINGS

Throughout the drawings, reference numbers can be reused to indicate correspondence between referenced elements. The drawings are provided to illustrate embodiments of the inventions described herein and not to limit the scope thereof.

DESCRIPTION OF EMBODIMENTS

I. Introduction

Surround sound systems attempt to create immersive audio environments by projecting sound from multiple speakers situated around a listener. Surround sound systems are typically preferred by audio enthusiasts over systems with fewer speakers, such as stereo systems. However, stereo systems are often cheaper by virtue of having fewer speakers, and thus, many attempts have been made to approximate the surround sound effect with stereo speakers. Despite such attempts, surround sound environments with more than two speakers are often more immersive than stereo systems.

This disclosure describes a depth processing system that employs stereo speakers to achieve immersive effects, among possibly other speaker configurations. The depth processing system can advantageously manipulate phase and/or amplitude information to render audio along a listener's median plane, thereby rendering audio at varying depths with respect to a listener. In one embodiment, the depth processing system analyzes left and right stereo input signals to infer depth, which may change over time. The depth processing system can then vary the phase and/or amplitude decorrelation between the audio signals over time, thereby creating an immersive depth effect.

The features of the audio systems described herein can be implemented in electronic devices, such as phones, televisions, laptops, other computers, portable media players, car stereo systems, and the like to create an immersive audio effect using two or more speakers.

II. Audio Depth Estimation and Rendering Embodiments

Figure 1A:
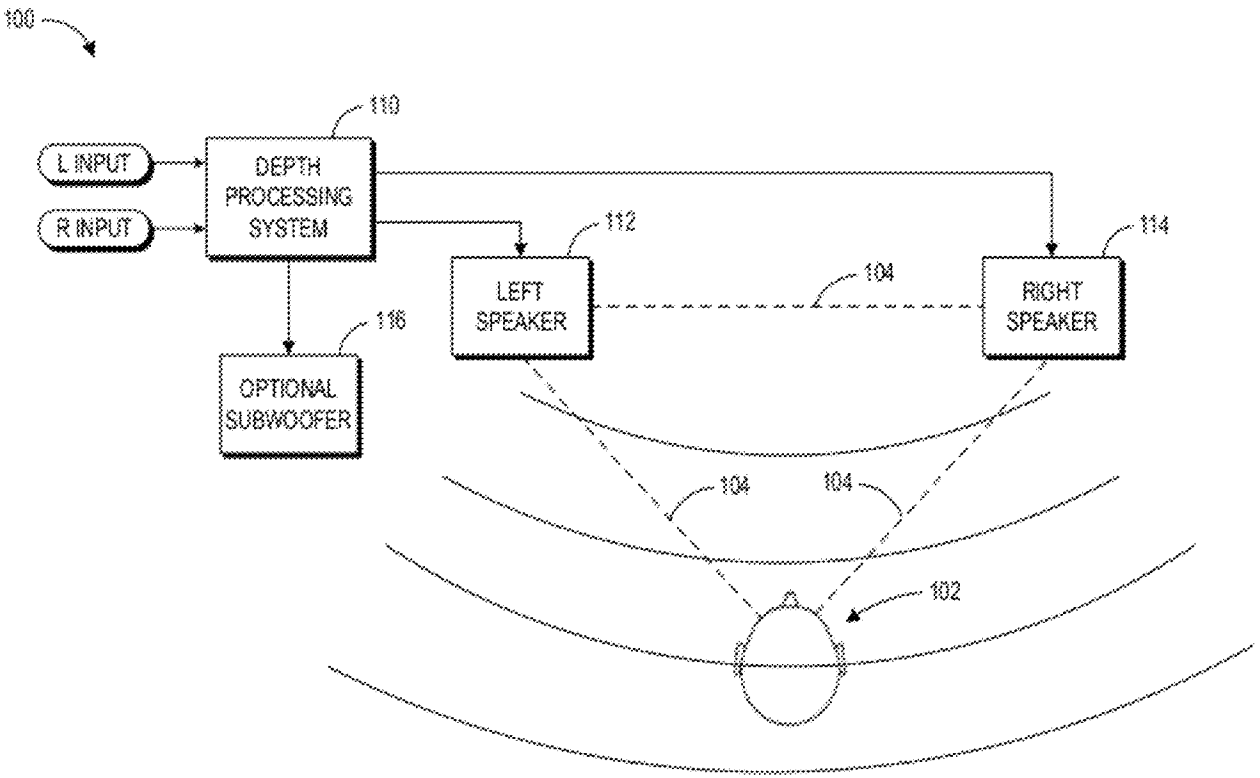
FIG. 1A illustrates an example depth rendering scenario that employs an embodiment of a depth processing system.

FIG. 1A illustrates an embodiment of an immersive audio environment 100. The immersive audio environment 100 shown includes a depth processing system 110 that receives two (or more) channel audio inputs and produces two channel audio outputs to left and right speakers 112, 114, with an optional third output to a subwoofer 116. Advantageously, in certain embodiments, the depth processing system 110 analyzes the two-channel audio input signals to estimate or infer depth information about those signals. Using this depth information, the depth processing system 110 can adjust the audio input signals to create a sense of depth in the audio output signals provided to the left and right stereo speakers 112, 114. As a result, the left and right speakers can output an immersive sound field (shown by curved lines) for a listener 102. This immersive sound field can create a sense of depth for the listener 102.

The immersive sound field effect provided by the depth processing system 110 can function more effectively than the immersive effects of surround sound speakers. Thus, rather than being considered an approximation to surround systems, the depth processing system 110 can provide benefits over existing surround systems. One advantage provided in certain embodiments is that the immersive sound field effect can be relatively sweet-spot independent, providing an immersive effect throughout the listening space. However, in some implementations, a heightened immersive effect can be achieved by placing the listener 102 approximately equidistant between the speakers and at an angle forming a substantially equilateral triangle with the two speakers (shown by dashed lines 104).

Figure 1B:
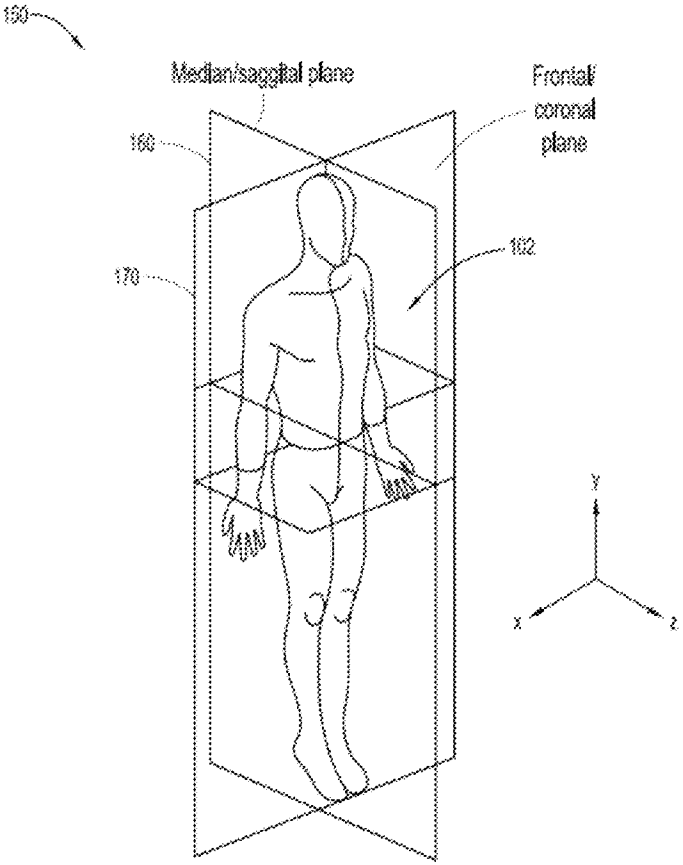
FIGS. 1B, 2A, and 2B illustrate aspects of a listening environment relevant to embodiments of depth rendering algorithms.

FIG. 1B illustrates aspects of a listening environment 150 relevant to embodiments of depth rendering. Shown is a listener 102 in the context of two geometric planes 160, 170 associated with the listener 102. These planes include a median or saggital plane 160 and a frontal or coronal plane 170. A three-dimensional audio effect can beneficially be obtained in some embodiments by rendering audio along the listener's 102 median plane.

An example coordinate system 180 is shown next to the listener 102 for reference. In this coordinate system 180, the median plane 160 lies in the y-z plane, and the coronal plane 170 lies in the x-y plane. The x-y plane also corresponds to a plane that may be formed between two stereo speakers facing the listener 102. The z-axis of the coordinate system 180 can be a normal line to such a plane. Rendering audio along the median plane 160 can be thought of in some implementations as rendering audio along the z-axis of the coordinate system 180. Thus, for example, a depth effect can be rendered by the depth processing system 110 along the median plane, such that some sounds sound closer to the listener along the median plane 160, and some sound farther from the listener 102 along the median plane 160.

The depth processing system 110 can also render sounds along both the median and coronal planes 160, 170. The ability to render in three dimensions in some embodiments can increase the listener's 102 sense of immersion in the audio scene and can also heighten the illusion of three-dimensional video when experienced together.

Figure 2B:
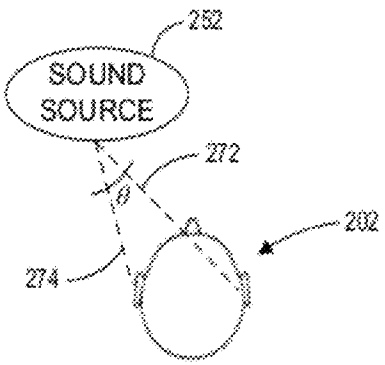
Figure 2A:
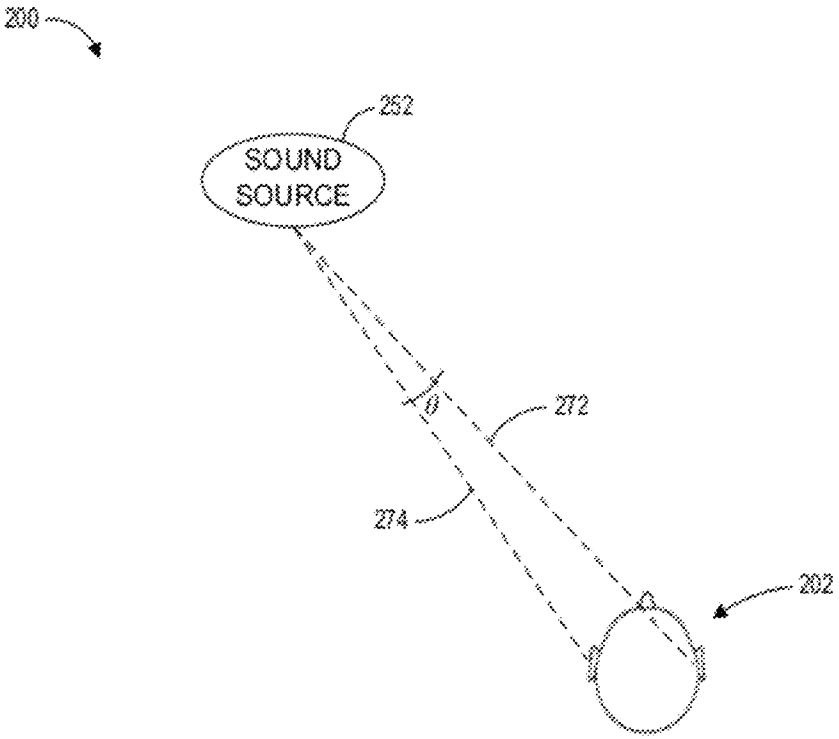

A listener's perception of depth can be visualized by the example sound source scenarios 200 depicted in FIGS. 2A and 2B. In FIG. 2A, a sound source 252 is positioned at a distance from a listener 202, whereas the sound source 252 is relatively closer to the listener 202 in FIG. 2B. A sound source is typically perceived by both ears, with the ear closer to the sound source 252 typically hearing the sound before the other ear. The delay in sound reception from one ear to the other can be considered an interaural time delay (ITD). Further, the intensity of the sound source can be greater for the closer ear, resulting in an interaural intensity difference (IID).

Lines 272, 274 drawn from the sound source 252 to each ear of the listener 202 in FIGS. 2A and 2B form an included angle. This angle is smaller at a distance and larger when the sound source 252 is closer, as shown in FIGS. 2A and 2B. The farther away a sound source 252 is from the listener 202, the more the sound source 252 approximates a point source with a 0 degree included angle. Thus, left and right audio signals may be relatively in-phase to represent a distant sound source 252, and these signals may be relatively out of phase to represent a closer sound source 252 (assuming a non-zero azimuthal arrival angle with respect to the listener 102, such that the sound source 252 is not directly in front of the listener). Accordingly, the ITD and IID of a distant source 252 may be relatively smaller than the ITD and IID of a closer source 252.

Stereo recordings, by virtue of having two speakers, can include information that can be analyzed to infer depth of a sound source 252 with respect to a listener 102. For example, ITD and IID information between left and right stereo channels can be represented as phase and/or amplitude decorrelation between the two channels. The more decorrelated the two channels are, the more spacious the sound field may be, and vice versa. The depth processing system 110 can advantageously manipulate this phase and/or amplitude decorrelation to render audio along the listener's 102 median plane 160, thereby rendering audio along varying depths. In one embodiment, the depth processing system 110 analyzes left and right stereo input signals to infer depth, which may change over time. The depth processing system 110 can then vary the phase and/or amplitude decorrelation between the input signals over time to create this sense of depth.

Figure 3A:
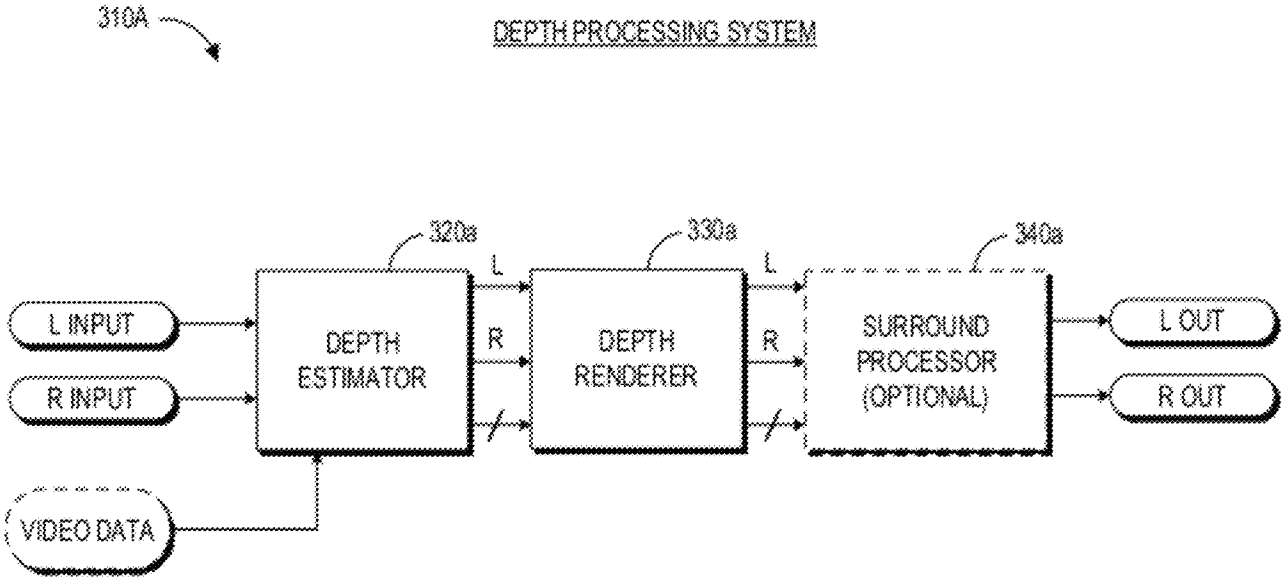
FIGS. 3A through 3D illustrate example embodiments of the depth processing system of FIG. 1.
Figure 3B:
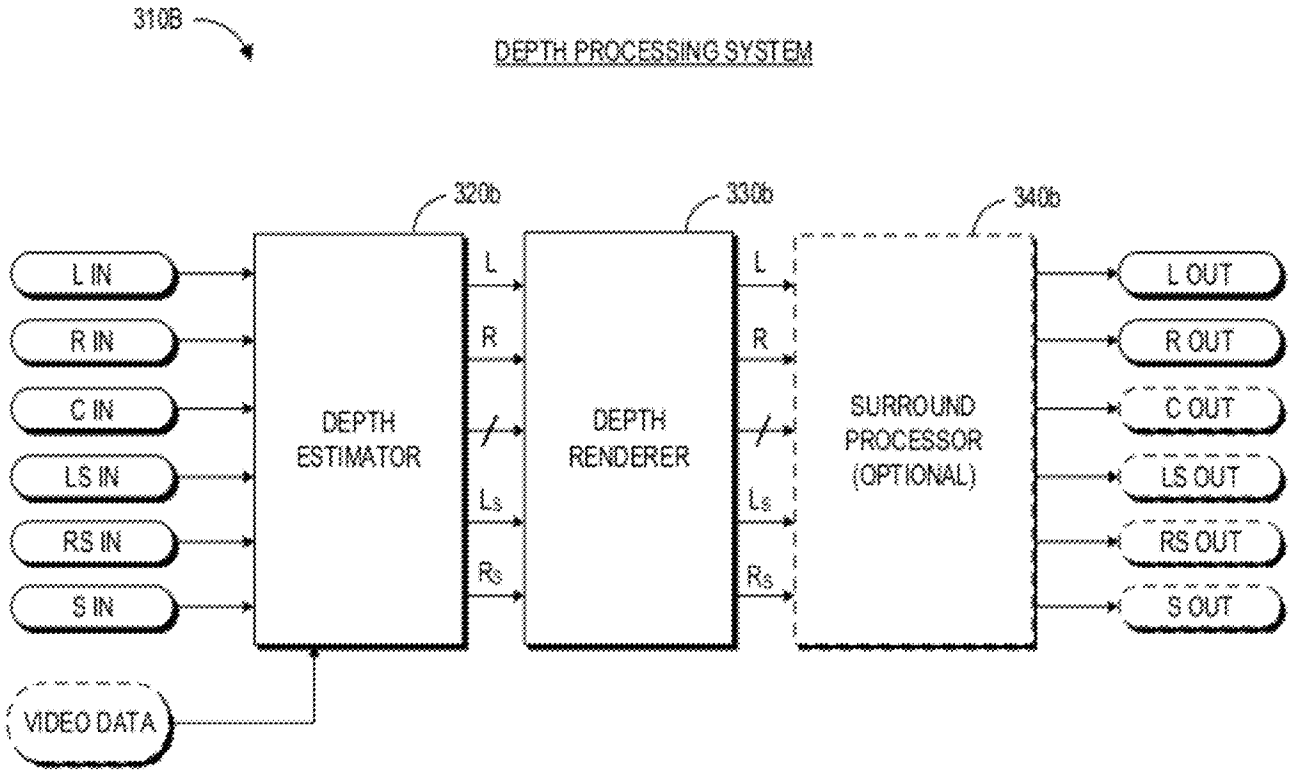
Figure 3C:
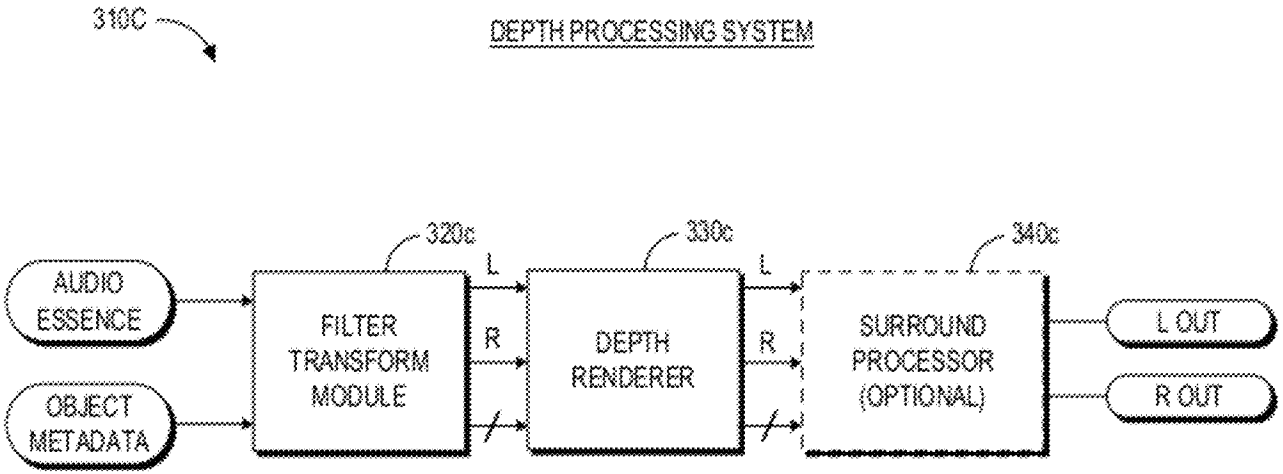
Figure 3D:
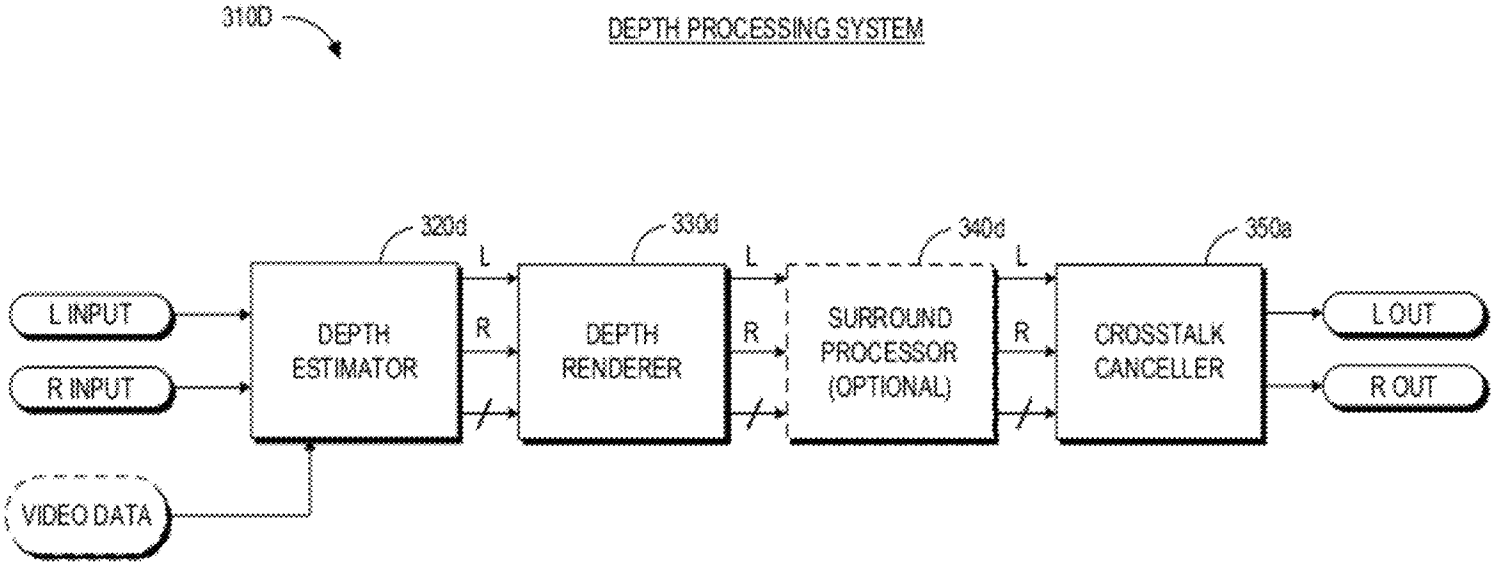

FIGS. 3A through 3D illustrate more detailed embodiments of depth processing systems 310. In particular, FIG. 3A illustrates a depth processing system 310A that renders a depth effect based on stereo and/or video inputs. FIG. 3B illustrates a depth processing system 310B that creates a depth effect based on surround sound and/or video inputs. In FIG. 3C, a depth processing system 310C creates a depth effect using audio object information. FIG. 3D is similar to FIG. 3A, except that an additional crosstalk cancellation component is provided. Each of these depth processing systems 310 can implement the features of the depth processing system 110 described above. Further, each of the components shown can be implemented in hardware and/or software.

Referring specifically to FIG. 3A, the depth processing system 310A receives left and right input signals, which are provided to a depth estimator 320*a*. The depth estimator 320*a* is an example of a signal analysis component that can analyze the two signals to estimate depth of the audio represented by the two signals. The depth estimator 320*a* can generate depth control signals based on this depth estimate, which a depth renderer 330*a* can use to emphasize phase and/or amplitude decorrelation (e.g., ITD and IID differences) between the two channels. The depth-rendered output signals are provided to an optional surround processing module 340*a* in the depicted embodiment, which can optionally broaden the sound stage and thereby increase the sense of depth.

In certain embodiments, the depth estimator 320*a* analyzes difference information in the left and right input signals, for example, by calculating an L−R signal. The magnitude of the L−R signal can reflect depth information in the two input signals. As described above with respect to FIGS. 2A and 2B, the L and R signals can become more out-of-phase as a sound moves closer to a listener. Thus, larger magnitudes in the L−R signal can reflect closer signals than smaller magnitudes of the L−R signal.

The depth estimator 320*a* can also analyze the separate left and right signals to determine which of the two signals is dominant. Dominance in one signal can provide clues as to how to adjust ITD and/or IID differences to emphasize the dominant channel and thereby emphasize depth. Thus, in some embodiments, the depth estimator 320*a* creates some or all of the following control signals: L−R, L, R, and also optionally L+R. The depth estimator 320*a* can use these control signals to adjust filter characteristics applied by the depth renderer 330*a* (described below).

In some embodiments, the depth estimator 320*a* can also determine depth information based on video information instead of or in addition to the audio-based depth analysis described above. The depth estimator 320*a* can synthesize depth information from three-dimensional video or can generate a depth map from two-dimensional video. From such depth information, the depth estimator 320*a* can generate control signals similar to the control signals described above. Video-based depth estimation is described in greater detail below with respect to FIGS. 10A through 12.

The depth estimator 320*a* may operate on sample blocks or on a sample-by-sample basis. For convenience, the remainder of this specification will refer to block-based implementations, although it should be understood that similar implementations may be performed on a sample-by-sample basis. In one embodiment, the control signals generated by the depth estimator 320*a* include a block of samples, such as a block of L−R samples, a block of L, R, and/or L+R samples, and so on. Further, the depth estimator 320*a* may smooth and/or detect an envelope of the L−R, L, R, or L+R signals. Thus, the control signals generated by the depth estimator 320*a* may include one or more blocks of samples representing a smoothed version and/or envelope of various signals.

Using these control signals, the depth estimator 320*a* can manipulate filter characteristics of one or more depth rendering filters implemented by the depth renderer 330*a*. The depth renderer 330*a* can receive the left and right input signals from the depth estimator 320*a* and apply the one or more depth rendering filters to the input audio signals. The depth rendering filter(s) of the depth renderer 330*a* can create a sense of depth by selectively correlating and decorrelating the left and right input signals. The depth rendering module can perform this correlation and decorrelation by manipulating phase and/or gain differences between the channels, based on the depth estimator 320*a* output. This decorrelation may be a partial decorrelation or full decorrelation of the output signals.

Advantageously, in certain embodiments, the dynamic decorrelation performed by the depth renderer 330*a* based on control or steering information derived from the input signals creates an impression of depth rather than mere stereo spaciousness. Thus, a listener may perceive a sound source as popping out of the speakers, dynamically moving toward or away from the listener. When coupled with video, sound sources represented by objects in the video can appear to move with the objects in the video, resulting in a 3-D audio effect.

In the depicted embodiment, the depth renderer 330*a* provides depth-rendered left and right outputs to a surround processor 340*a*. The surround processor 340*a* can broaden the sound stage, thereby widening the sweet spot of the depth rendering effect. In one embodiment, the surround processor 340*a* broadens the sound stage using one or more head-related transfer functions or the perspective curves described in U.S. Pat. No. 7,492,907, the disclosure of which is hereby incorporated by reference in its entirety. In one embodiment, the surround processor 340*a* modulates this sound-stage broadening effect based on one or more of the control or steering signals generated by the depth estimator 320*a*. As a result, the sound stage can advantageously be broadened according to the amount of depth detected, thereby further enhancing the depth effect. The surround processor 340*a* can output left and right output signals for playback to a listener (or for further processing; see, e.g., FIG. 3D). However, the surround processor 340*a* is optional and may be omitted in some embodiments.

The depth processing system 310A of FIG. 3A can be adapted to process more than two audio inputs. For example, FIG. 3B depicts an embodiment of the depth processing system 310B that processes 5.1 surround sound channel inputs. These inputs include left front (L), right front (R), center (C), left surround (LS), right surround (RS), and subwoofer (S) inputs.

The depth estimator 320*b*, the depth renderer 320*b*, and the surround processor 340*b* can perform the same or substantially the same functionality as the depth estimator 320*a* and depth renderer 320*a*, respectively. The depth estimator 320*b* and depth renderer 320*b* can treat the LS and RS signals as separate L and R signals. Thus, the depth estimator 320*b* can generate a first depth estimate/control signals based on the L and R signals and a second depth estimate/control signals based on the LS and RS signals. The depth processing system 310B can output depth-processed L and R signals and separate depth-processed LS and RS signals. The C and S signals can be passed through to the outputs, or enhancements can be applied to these signals as well.

The surround sound processor 340*b* may downmix the depth-rendered L, R, LS, and RS signals (as well as optionally the C and/or S signals) into two L and R outputs. Alternatively, the surround sound processor 340*b* can output full L, R, C, LS, RS, and S outputs, or some other subset thereof.

Referring to FIG. 3C, another embodiment of the depth processing system 310C is shown. Rather than receiving discrete audio channels, in the depicted embodiment, the depth processing system 310C receives audio objects. These audio objects include audio essence (e.g., sounds) and object metadata. Examples of audio objects can include sound sources or objects corresponding to objects in a video (such as a person, machine, animal, environmental effects, etc.). The object metadata can include positional information regarding the position of the audio objects. Thus, in one embodiment depth estimation is not needed, as the depth of an object with respect to a listener is explicitly encoded in the audio objects. Instead of a depth estimation module, a filter transform module 320*c* is provided, which can generate appropriate depth-rendering filter parameters (e.g., coefficients and/or delays) based on the object position information. The depth renderer 330*c* can then proceed to perform dynamic decorrelation based on the calculated filter parameters. An optional surround processor 340*c* is also provided, as described above.

The position information in the object metadata may be in the format of coordinates in three-dimensional space, such as x, y, z coordinates, spherical coordinates, or the like. The filter transform module 320*c* can determine filter parameters that create changing phase and gain relationships based on changing positions of objects, as reflected in the metadata. In one embodiment, the filter transform module 320*c* creates a dual object from the object metadata. This dual object can be a two-source object, similar to a stereo left and right input signal. The filter transform module 320*c* can create this dual object from a monophone audio essence source and object metadata or a stereo audio essence source with object metadata. The filter transform module 320*c* can determine filter parameters based on the metadata-specified positions of the dual objects, their velocities, accelerations, and so forth. The positions in three-dimensional space may be interior points in a sound field surrounding a listener. Thus, the filter transform module 320*c* can interpret these interior points as specifying depth information that can be used to adjust filter parameters of the depth renderer 330*c*. The filter transform module 320*c* can cause the depth renderer 320*c* to spread or diffuse the audio as part of the depth rendering effect in one embodiment.

As there may be several objects in an audio object signal, the filter transform module 320*c* can generate the filter parameters based on the position(s) of one or more dominant objects in the audio, rather than synthesizing an overall position estimate. The object metadata may include specific metadata indicating which objects are dominant, or the filter transform module 320*c* may infer dominance based on an analysis of the metadata. For example, objects having metadata indicating that they should be rendered louder than other objects can be considered dominant, or objects that are closer to a listener can be dominant, and so forth.

The depth processing system 310C can process any type of audio object, including MPEG-encoded objects or the audio objects described in U.S. application Ser. No. 12/856,442, filed Aug. 13, 2010, titled "Object-Oriented Audio Streaming System," the disclosure of which is hereby incorporated by reference in its entirety. In some embodiments, the audio objects may include base channel objects and extension objects, as described in U.S. Provisional Application No.

61/451,085, filed Mar. 9, 2011, titled "System for Dynamically Creating and Rendering Audio Objects," the disclosure of which is hereby incorporated by reference in its entirety. Thus, in one embodiment the depth processing system 310C may perform depth estimation (using, e.g., a depth estimator 320) from the base channel objects and may also perform filter transform modulation (block 320*c*) based on the extension objects and their respective metadata. In other words, audio object metadata may be used in addition to or instead of channel data for determining depth.

In FIG. 3D, another embodiment of the depth processing system 310*d* is shown. This depth processing system 310*d* is similar to the depth processing system 310*a* of FIG. 3A, with the addition of a crosstalk canceller 350*a*. While the crosstalk canceller 350*a* is shown together with the features of the processing system 310*a* of FIG. 3A, the crosstalk canceller 350*a* can actually be included in any of the preceding depth processing systems. The crosstalk canceller 350*a* can advantageously improve the quality of the depth rendering effect for some speaker arrangements.

Crosstalk can occur in the air between two stereo speakers and the ears of a listener, such that sounds from each speaker reach both ears instead of being localized to one ear. In such situations, a stereo effect is degraded. Another type of crosstalk can occur in some speaker cabinets that are designed to fit in tight spaces, such as underneath televisions. These downward facing stereo speakers often do not have individual enclosures. As a result, backwave sounds emanating from the back of these speakers (which can be inverted versions of the sounds emanating from the front) can create a form of crosstalk with each other due to backwave mixing. This backwaving mixing crosstalk can diminish or completely cancel the depth rendering effects described herein.

Figure 3E:
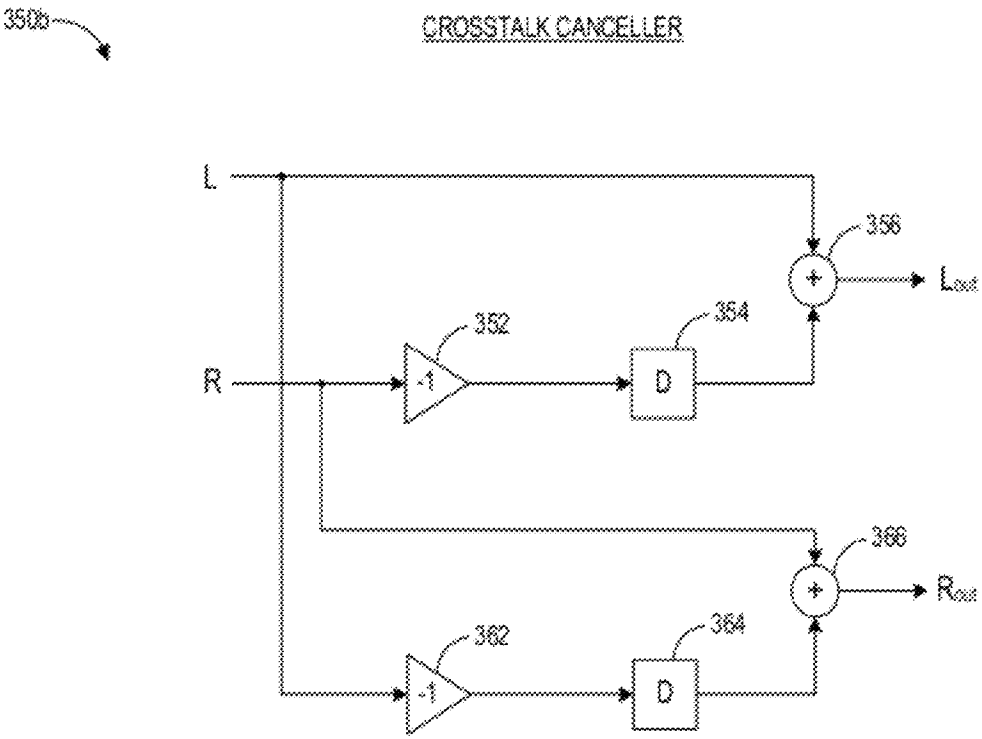
FIG. 3E illustrates an embodiment of a crosstalk canceller that can be included in any of the depth processing systems described herein.

To combat these effects, the crosstalk canceller 350*a* can cancel or otherwise reduce crosstalk between the two speakers. In addition to facilitating better depth rendering for television speakers, the crosstalk canceller 350*a* can facilitate better depth rendering for other speakers, including back-facing speakers on cell phones, tablets, and other portable electronic devices. One example of a crosstalk canceller 350 is shown in more detail in FIG. 3E. This crosstalk canceller 350*b* represents one of many possible implementations of the crosstalk canceller 350*a* of FIG. 3D.

The crosstalk canceller 350*b* receives two signals, left and right, which have been processed with depth effects as described above. Each signal is inverted by an inverter 352, 362. The output of each inverter 352, 362 is delayed by a delay block 354, 364. The output of the delay block is summed with an input signal at summer 356, 366. Thus, each signal is inverted, delayed, and summed with the opposite input signal to produce an output signal. If the delay is chosen correctly, the inverted and delayed signal should cancel out or at least partially reduce the crosstalk due to backwave mixing (or other crosstalk).

The delay in the delay blocks 354, 364 can represent the difference in sound wave travel time between two ears and can depend on the distance of the listener to the speakers. The delay can be set by a manufacturer for a device incorporating the depth processing system 110, 310 to match an expected delay for most users of the device. A device where the user sits close to the device (such as a laptop) is likely to have a shorter delay than a device where the user sits far from the device (such as a television). Thus, delay settings can be customized based on the type of device used. These delay settings can be exposed in a user interface for selection by a user (e.g., the manufacturer of the device, installer of software on the device, or end-user, etc.). Alternatively, the delay can be preset. In another embodiment, the delay can change dynamically based on position information obtained about a position of a listener relative to the speakers. This position information can be obtained from a camera or optical sensor, such as the Xbox™ Kinect™ available from Microsoft™ Corporation.

Other forms of crosstalk cancellers may be used that may also include head-related transfer function (HRTF) filters or the like. If the surround processor 340, which may already include HRTF-derived filters, were removed from the system, adding HRTF filters to the crosstalk canceller 350 may provide a larger sweet spot and sense of spaciousness. Both the surround processor 340 and the crosstalk canceller 350 can include HRTF filters in some embodiments.

Figure 4:
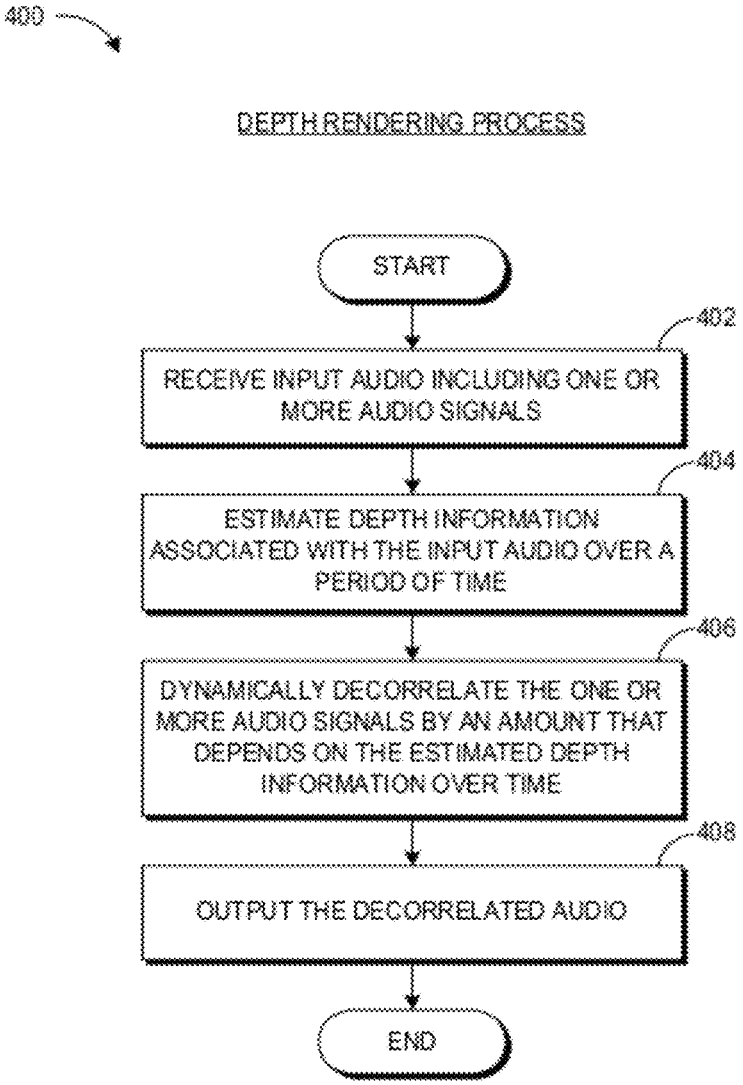
FIG. 4 illustrates an embodiment of a depth rendering process that can be implemented by any of the depth processing systems described herein.

FIG. 4 illustrates an embodiment of a depth rendering process 400 that can be implemented by any of the depth processing systems 110, 310 described herein or by other systems not described herein. The depth rendering process 400 illustrates an example approach for rendering depth to create an immersive audio listening experience.

At block 402, input audio including one or more audio signals is received. The two or more audio signals can include left and right stereo signals, 5.1 surround signals as described above, other surround configurations (e.g., 6.1, 7.1, etc.), audio objects, or even monophonic audio that the depth processing system can convert to stereo prior to depth rendering. At block 404, depth information associated with the input audio over a period of time is estimated. The depth information may be estimated directly from an analysis of the audio itself, as described above (see also FIG. 5), from video information, from object metadata, or from any combination of the same.

The one or more audio signals are dynamically decorrelated by an amount that depends on the estimated depth information at block 406. The decorrelated audio is output at block 408. This decorrelation can involve adjusting phase and/or gain delays between two channels of audio dynamically based on the estimated depth. The estimated depth can therefore act as a steering signal that drives the amount of decorrelation created. As sound sources in the input audio move from one speaker to another, the decorrelation can change dynamically in a corresponding fashion. For instance, in a stereo setting, if a sound moves from a left to right speaker, the left speaker output may first be emphasized, followed by the right speaker output being emphasized as the sound source moves to the right speaker. In one embodiment, decorrelation can effectively result in increasing the difference between two channels, producing a greater L−R or LS−RS value.

Figure 5:
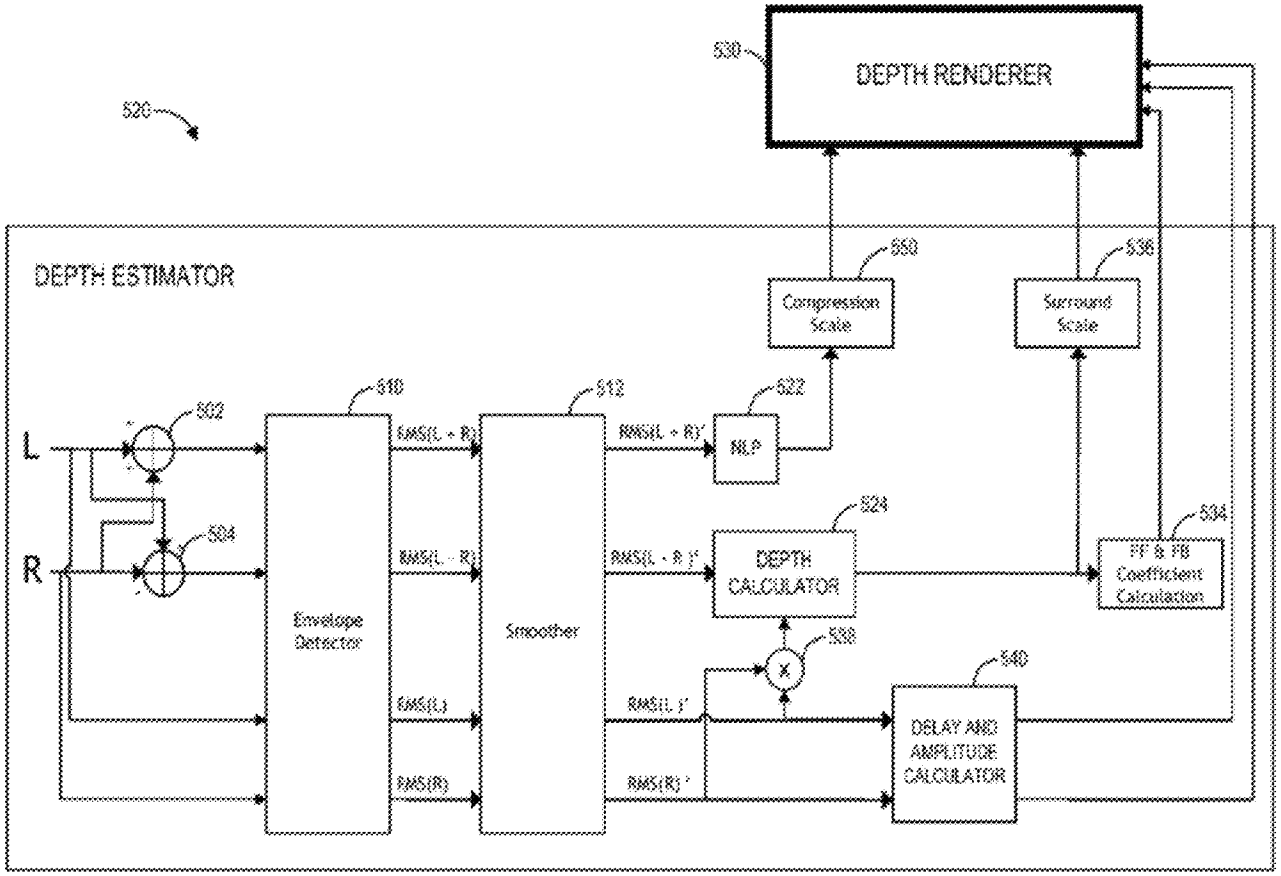
FIG. 5 illustrates an embodiment of a depth estimator.

FIG. 5 illustrates a more detailed embodiment of a depth estimator 520. The depth estimator 520 can implement any of the features of the depth estimators 320 described above. In the depicted embodiment, the depth estimator 520 estimates depth based on left and right input signals and provides outputs to a depth renderer 530. The depth estimator 520 can also be used to estimate depth from left and right surround input signals. Further, embodiments of the depth estimator 520 can be used in conjunction with video depth estimators or object filter transform modules described herein.

The left and right signals are provided to sum and difference blocks 502, 504. In one embodiment, the depth estimator 520 receives a block of left and right samples at a time. The remainder of the depth estimator 520 can therefore manipulate the block of samples. The sum block 502 produces an L+R output, while the difference block 504 produces an L−R output. Each of these outputs, along with the original inputs, is provided to an envelope detector 510.

The envelope detector 510 can use any of a variety of techniques to detect envelopes in the L+R, L−R, L, and R signals (or a subset thereof). One envelope detection technique is to take a root-mean square (RMS) value of a signal. Envelope signals output by the envelope detector 510 are therefore shown as RMS(L−R), RMS(L), RMS(R), and RMS (L+R). These RMS outputs are provided to a smoother 512, which applies a smoothing filter to the RMS outputs. Taking the envelope and smoothing the audio signals can smooth out variations (such as peaks) in the audio signals, thereby avoiding or reducing subsequent abrupt or jarring changes in depth processing. In one embodiment, the smoother 512 is a fast-attack, slow-decay (FASD) smoother. In another embodiment, the smoother 512 can be omitted.

The outputs of the smoother 512 are denoted as RMS( )' in FIG. 5. The RMS(L+R)' signal is provided to a depth calculator 524. As described above, the magnitude of the L−R signal can reflect depth information in the two input signals. Thus, the magnitude of the RMS and smoothed L−R signal can also reflect depth information. For example, larger magnitudes in the RMS(L−R)' signal can reflect closer signals than smaller magnitudes of the RMS(L−R)' signal. Said another way, the values of the L−R or RMS(L−R)' signal reflect the degree of correlation between the L−R signals. In particular, the L−R or RMS(L−R)' (or RMS(L−R)) signal can be an inverse indicator of the interaural cross-correlation coefficient (IACC) between the left and right signals. (If the L and R signals are highly correlated, for example, their L—R value will be close to 0, while their IACC value will be close to 1, and vice versa.)

Since the RMS(L−R)' signal can reflect the inverse correlation between L and R signals, the RMS(L−R)' signal can be used to determine how much decorrelation to apply between the L and R output signals. The depth calculator 524 can further process the RMS(L−R)' signal to provide a depth estimate, which can be used to apply decorrelation to the L and R signals. In one embodiment, the depth calculator 524 normalizes the RMS(L−R)' signal. For example, the RMS values can be divided by a geometric mean (or other mean or statistical measure) of the L and R signals (e.g., (RMS(L)'*RMS(R)')^(½)) to normalize the envelope signals. Normalization can help ensure that fluctuations in signal level or volume are not misinterpreted as fluctuations in depth. Thus, as shown in FIG. 5, the RMS(L)' and RMS(R)' values are multiplied together at multiplication block 538 and provided to the depth calculator 524, which can complete the normalization process.

In addition to normalizing the RMS(L−R)' signal, the depth calculator 524 can also apply additional processing. For instance, the depth calculator 524 may apply non-linear processing to the RMS(L−R)' signal. This non-linear processing can accentuate the magnitude of the RMS(L−R)' signal to thereby nonlinearly emphasize the existing decorrelation in the RMS(L−R)' signal. Thus, fast changes in the L−R signal can be emphasized even more than slow changes to the L−R signal. The non-linear processing is a power function or exponential in one embodiment, or greater than linear increase in another embodiment. For example, the depth calculator 524 can use an exponential function such as x^a, where x=RMS (L−R)' and a >1. Other functions, including different forms of exponential functions, may be chosen for the nonlinear processing.

The depth calculator 524 provides the normalized and nonlinear-processed signal as a depth estimate to a coefficient calculation block 534 and to a surround scale block 536. The coefficient calculation block 534 calculates coefficients of a depth rendering filter based on the magnitude of the depth estimate. The depth rendering filter is described in greater detail below with respect to FIGS. 6A and 6B. However, it should be noted that in general, the coefficients generated by the calculation block 534 can affect the amount of phase delay and/or gain adjustment applied to the left and right audio signals. Thus, for example, the calculation block 534 can generate coefficients that produce greater phase delay for greater values of the depth estimate and vice versa. In one embodiment, the relationship between phase delay generated by the calculation block 534 and the depth estimate is nonlinear, such as a power function or the like. This power function can have a power that is optionally a tunable parameter based on the closeness of a listener to the speakers, which may be determined by the type of device in which the depth estimator 520 is implemented. Televisions may have a greater expected listener distance than cell phones, for example, and thus the calculation block 534 can tune the power function differently for these or other types of devices. The power function applied by the calculation block 534 can magnify the effect of the depth estimate, resulting in coefficients of the depth rendering filter that result in an exaggerated phase and/or amplitude delay. In another embodiment, the relationship between the phase delay and the depth estimate is linear instead of nonlinear (or a combination of both).

The surround scale module 536 can output a signal that adjusts an amount of surround processing applied by the optional surround processor 340. The amount of decorrelation or spaciousness in the L−R content, as calculated by the depth estimate, can therefore modulate the amount of surround processing applied. The surround scale module 536 can output a scale value that has greater values for greater values of the depth estimate and lower values for lower values of the depth estimate. In one embodiment, the surround scale module 536 applies nonlinear processing, such as a power function or the like, to the depth estimate to produce the scale value. For example, the scale value can be some function of a power of the depth estimate. In other embodiments, the scale value and the depth estimate have a linear instead of nonlinear relationship (or a combination of both). More detail on the processing applied by the scale value is described below with respect to FIGS. 13 through 17.

Separately, the RMS(L)' and RMS(R)' signals are also provided to a delay and amplitude calculation block 540. The calculation block 540 can calculate the amount of delay to be applied in the depth rendering filter (FIGS. 6A and 6B), for example, by updating a variable delay line pointer. In one embodiment, the calculation block 540 determines which of the L and R signals (or their RMS( ) equivalent) is dominant or higher in level. The calculation block 540 can determine this dominance by taking a ratio of the two signals, as RMS (L)'/RMS(R)', with values greater than 1 indicating left dominance and less than 1 indicating right dominance (or vice versa if the numerator and denominator are reversed). Alternatively, the calculation block 540 can perform a simple difference of the two signals to determine the signal with the greater magnitude.

If the left signal is dominant, the calculation block 540 can adjust a left portion of the depth rendering filter (FIG. 6A) to decrease the phase delay applied to the left signal. If the right signal is dominant, the calculation block 540 can perform the same for the filter applied to the right signal (FIG. 6B). As the dominance in the signals changes, the calculation block 540 can change the delay line values for the depth rendering filter, causing a push-pull change in phase delays over time between the left and right channels. This push-pull change in phase delay can be at least partly responsible for selectively increasing decorrelation between the channels and increasing correlation between the channels (e.g., during times when dominance changes). The calculation block 540 can fade between left and right delay dominance in response to changes in left and right signal dominance to avoid outputting jarring changes or signal artifacts.

Further, the calculation block 540 can calculate an overall gain to be applied to left and right channels based on the ratio of the left and right signals (or processed, e.g., RMS, values thereof). The calculation block 540 can change these gains in a push-pull fashion, similar to the push-pull change of the phase delays. For example, if the left signal is dominant, then the calculation block 540 can amplify the left signal and attenuate the right signal. As the right signal becomes dominant, the calculation block 540 can amplify the right signal and attenuate the left signal, and so on. The calculation block 540 can also crossfade gains between channels to avoid jarring gain transitions or signal artifacts.

Thus, in certain embodiments, the delay and amplitude calculator calculates parameters that cause the depth renderer 530 to decorrelate in phase delay and/or gain. In effect, the delay and amplitude calculator 540 can cause the depth renderer 530 to act as a magnifying glass or amplifier that amplifies existing phase and/or gain decorrelation between left and right signals. Either solely phase delay decorrelation or gain decorrelation may be performed in any given embodiment.

The depth calculator 524, coefficient calculation block 534, and calculation block 540 can work together to control the depth renderer's 530 depth rendering effect. Accordingly, in one embodiment, the amount of depth rendering brought about by decorrelation can depend on possibly multiple factors, such as the dominant channel and the (optionally processed) difference information (e.g., L−R and the like). As will be described in greater detail below with respect to FIGS. 6A and 6B, the coefficient calculation from block 534 based on the difference information can turn on or off a phase delay effect provided by the depth renderer 530. Thus, in one embodiment, the difference information effectively controls whether phase delay is performed, while the channel dominance information controls the amount of phase delay and/or gain decorrelation is performed. In another embodiment, the difference information also affects the amount of phase decorrelation and/or gain decorrelation performed.

In other embodiments than those shown, the output of the depth calculator 524 can be used to control solely an amount of phase and/or amplitude decorrelation, while the output of the calculation block 540 can be used to control coefficient calculation (e.g., can be provided to the calculation block 534). In another embodiment, the output of the depth calculator 524 is provided to the calculation block 540, and the phase and amplitude decorrelation parameter outputs of the calculation block 540 are controlled based on both the difference information and the dominance information. Similarly, the coefficient calculation block 534 could take additional inputs from the calculation block 540 and compute the coefficients based on both difference information and dominance information.

The RMS(L+R)' signal is also provided to a non-linear processing (NLP) block 522 in the depicted embodiment. The NLP block 522 can perform similar NLP processing to the RMS(L+R)' signal as was applied by the depth calculator 524, for example, by applying an exponential function to the RMS (L+R)' signal. In many audio signals, the L+R information includes dialog and is often used as a replacement for a center channel. Emphasizing the value of the L+R block via nonlinear processing can be useful in determining how much dynamic range compression to apply to the L+R or C signal. Greater values of compression can result in louder and therefore clearer dialog. However, if the value of the L+R signal is very low, no dialog may be present, and therefore the amount of compression applied can be reduced. Thus, the output of the NLP block 522 can be used by a compression scale block 550 to adjust the amount of compression applied to the L+R or C signal.

It should be noted that many aspects of the depth estimator 520 can be modified or omitted in different implementations. For instance, the envelope detector 510 or smoother 512 may be omitted. Thus, depth estimations can be made based directly on the L−R signal, and signal dominance can be based directly on the L and R signals. Then, the depth estimate and dominance calculations (as well as compression scale calculations based on L+R) can be smoothed instead of smoothing the input signals. Further, in another embodiment, the L−R signal (or a smoothed/envelope version thereof) or the depth estimate from the depth calculator 524 can be used to adjust the delay line pointer calculation in the calculation block 540. Likewise, the dominance between L and R signals (e.g., as calculated by a ratio or difference) can be used to manipulate the coefficient calculations in block 534. The compression scale block 550 or surround scale block 536 may be omitted as well. Many other additional aspects may also be included in the depth estimator 520, such as video depth estimation, which is described in greater detail below.

Figure 6A:
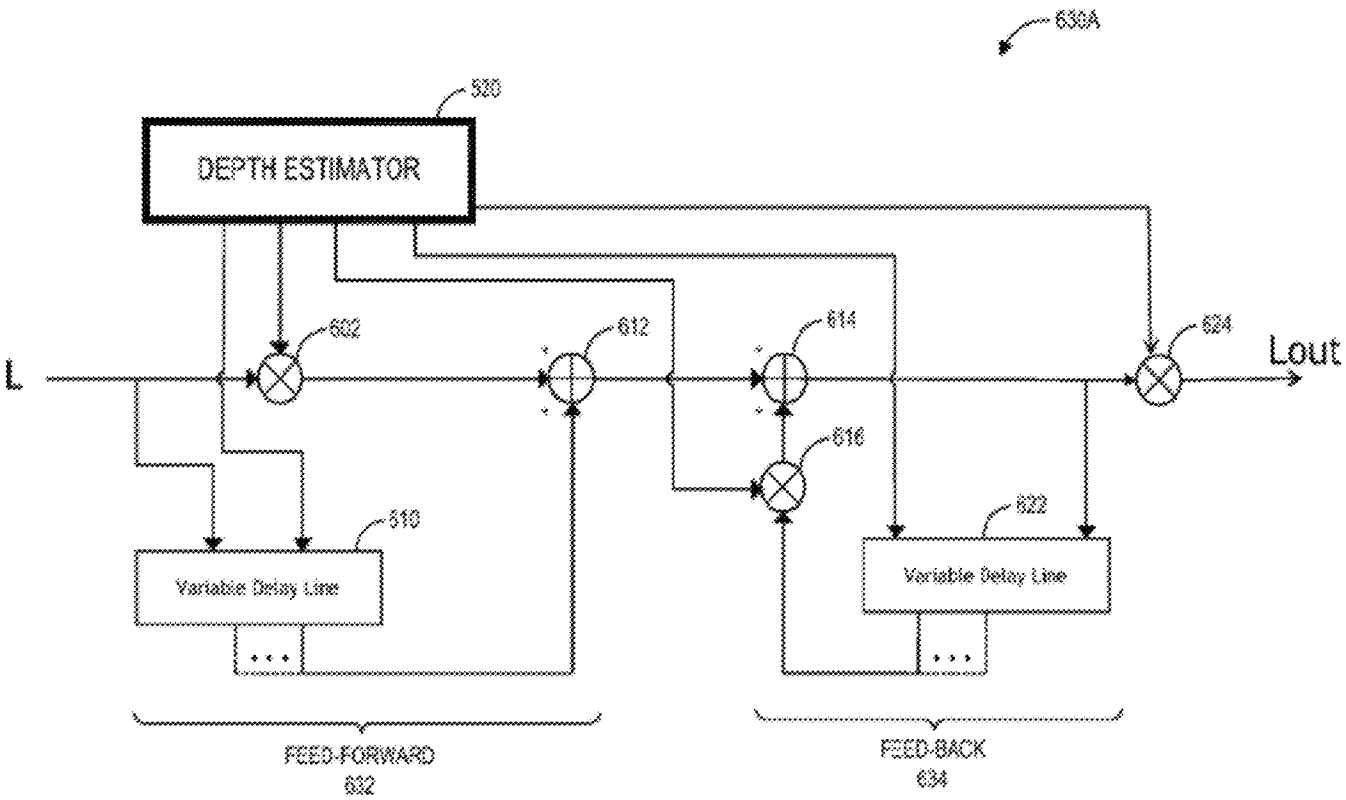
FIGS. 6A and 6B illustrate embodiments of depth renderers.
Figure 6B:
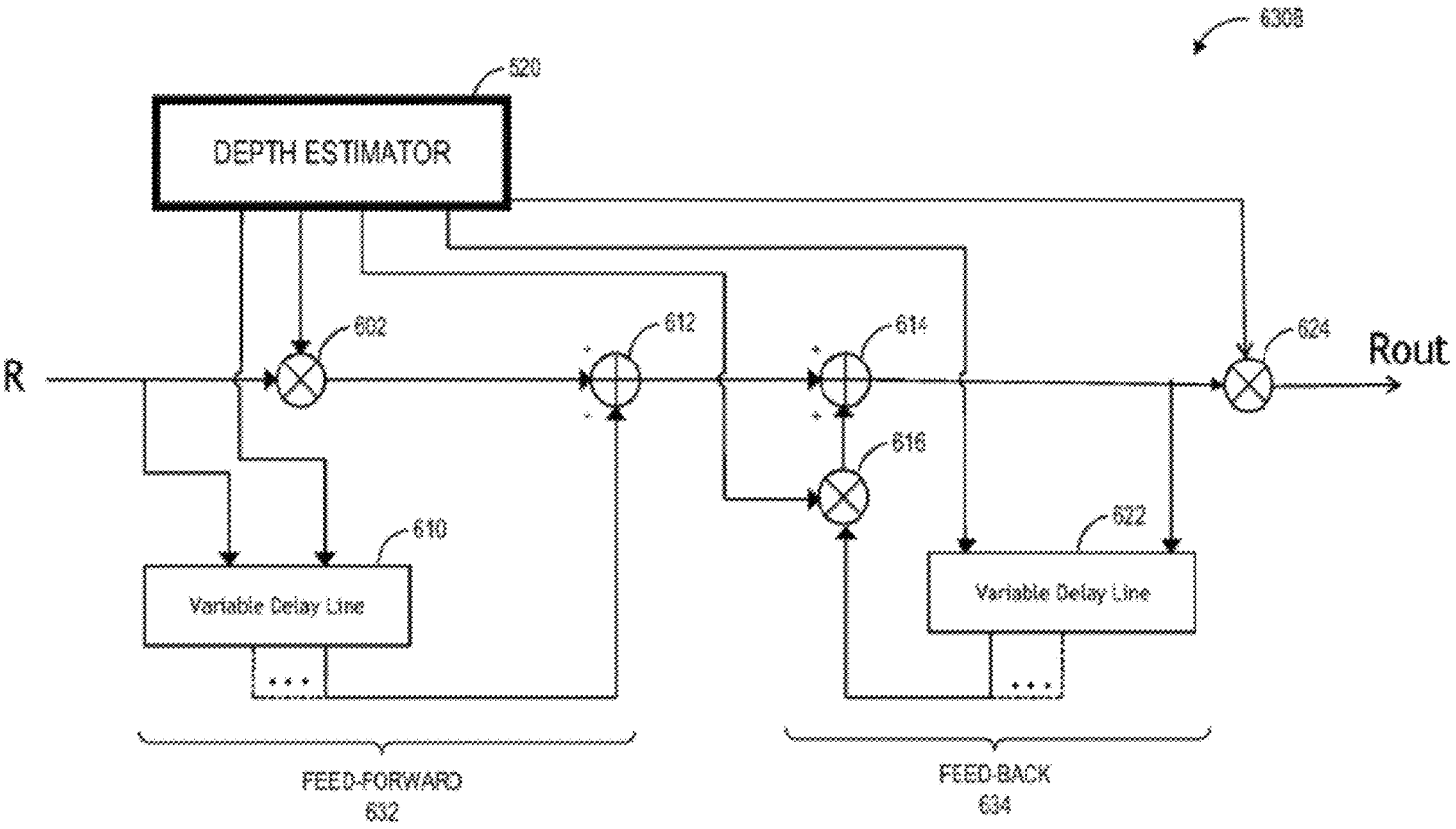

FIGS. 6A and 6B illustrate embodiments of depth renderers 630*a*, 630*b* and represent more detailed embodiments of the depth renderers 330, 530 described above. The depth renderer 630*a* in FIG. 6A applies a depth rendering filter for the left channel, while the depth renderer 630*b* in FIG. 6B applies a depth rendering filter for the right channel. The components shown in each FIGURE are therefore the same (although differences may be provided between the two filters in some embodiments). Thus, for convenience, the depth renders 630*a*, 630*b* will be described generically as a single depth renderer 630.

The depth estimator 520 described above (and reproduced in FIGS. 6A and 6B) can provide several inputs to the depth renderer 630. These inputs include one or more delay line pointers provided to variable delay lines 610, 622, feedforward coefficients applied to multiplier 602, feedback coefficients applied to multiplier 616, and an overall gain value applied to multiplier 624 (e.g., obtained from block 540 of FIG. 5).

The depth renderer 630 is, in certain embodiments, an all-pass filter that can adjust the phase of the input signal. In the depicted embodiment, the depth renderer 630 is an infinite impulse response (IIR) filter having a feed-forward component 632 and a feedback component 634. In one embodiment, the feedback component 634 can be omitted to obtain a substantially similar phase-delay effect. However, without the feedback component 634, a comb-filter effect can occur that potentially causes some audio frequencies to be nulled or otherwise attenuated. Thus, the feedback component 634 can advantageously reduce or eliminate this comb-filter effect. The feed-forward component 632 represents the zeros of the filter 630A, while the feedback component represents the poles of the filter (see FIGS. 7 and 8).

The feed-forward component 632 includes a variable delay line 610, a multiplier 602, and a combiner 612. The variable delay line 610 takes as input the input signal (e.g., the left signal in FIG. 6A), delays the signal according to an amount determined by the depth estimator 520, and provides the delayed signal to the combiner 612. The input signal is also provided to the multiplier 602, which scales the signal and provides the scaled signal to the combiner 612. The multiplier 602 represents the feed-forward coefficient calculated by the coefficient calculation block 534 of FIG. 5.

The output of the combiner 612 is provided to the feedback component 634, which includes a variable delay line 622, a multiplier 616, and a combiner 614. The output of the feed-forward component 632 is provided to the combiner 614, which provides an output to the variable delay line 622. The variable delay line 622 has a corresponding delay to the delay of the variable delay line 610 and depends on an output by the depth estimator 520 (see FIG. 5). The output of the delay line 622 is a delayed signal that is provided to the multiplier block 616. The multiplier block 616 applies the feedback coefficient calculated by the coefficient calculation block 534 (see FIG. 5). The output of this block 616 is provided to the combiner 614, which also provides an output to a multiplier 624. This multiplier 624 applies an overall gain (described below) to the output of the depth rendering filter 630.

The multiplier 602 of the feed-forward component 632 can control a wet/dry mix of the input signal plus the delayed signal. More gain applied to the multiplier 602 can increase the amount of input signal (the dry or less reverberant signal) versus the delayed signal (the wet or more reverberant signal), and vice versa. Applying less gain to the input signal can cause the phase-delayed version of the input signal to predominate, emphasizing a depth effect, and vice versa. An inverted version of this gain (not shown) may be included in the variable delay block 610 to compensate for the extra gain applied by the multiplier 602. The gain of the multiplier 616 can be chosen to correspond with the gain 602 so as to appropriately cancel out the comb-filter nulls. The gain of the multiplier 602 can therefore, in certain embodiments, modulate a time-varying wet-dry mix.

In operation, the two depth rendering filters 630A, 630B can be controlled by the depth estimator 520 to selectively correlate and decorrelate the left and right input signals (or LS and RS signals). To create an interaural time delay and therefore a sense of depth coming from the left (assuming that greater depth is detected from the left), the left delay line 610 (FIG. 6A) can be adjusted in one direction while adjusting the right delay line 610 (FIG. 6B) in the opposite direction. Adjusting the delays in an opposite manner between the two channels can create phase differences between the channels and thereby decorrelate the channels. Similarly, an interaural intensity difference can be created by adjusting the left gain (multiplier block 624 in FIG. 6A) in one direction while adjusting the right gain (multiplier block 624 in FIG. 6B) in the other direction. Thus, as depth in the audio signals shifts between the left and right channels, the depth estimator 520 can adjust the delays and gains in a push-pull fashion between the channels. Alternatively, only one of the left and right delays and/or gains are adjusted at any given time.

In one embodiment, the depth estimator 520 randomly varies the delays (in the delay lines 610) or gains 624 to randomly vary the ITD and IID differences in the two channels. This random variation can be small or large, but subtle random variations can result in a more natural-sounding immersive environment in some embodiments. Further, as sound sources move farther or closer away from the listener in the input audio signal, the depth rendering module can apply linear fading and/or smoothing (not shown) to the output of the depth rendering filter 630 to provide smooth transitions between depth adjustments in the two channels.

Figure 7A:
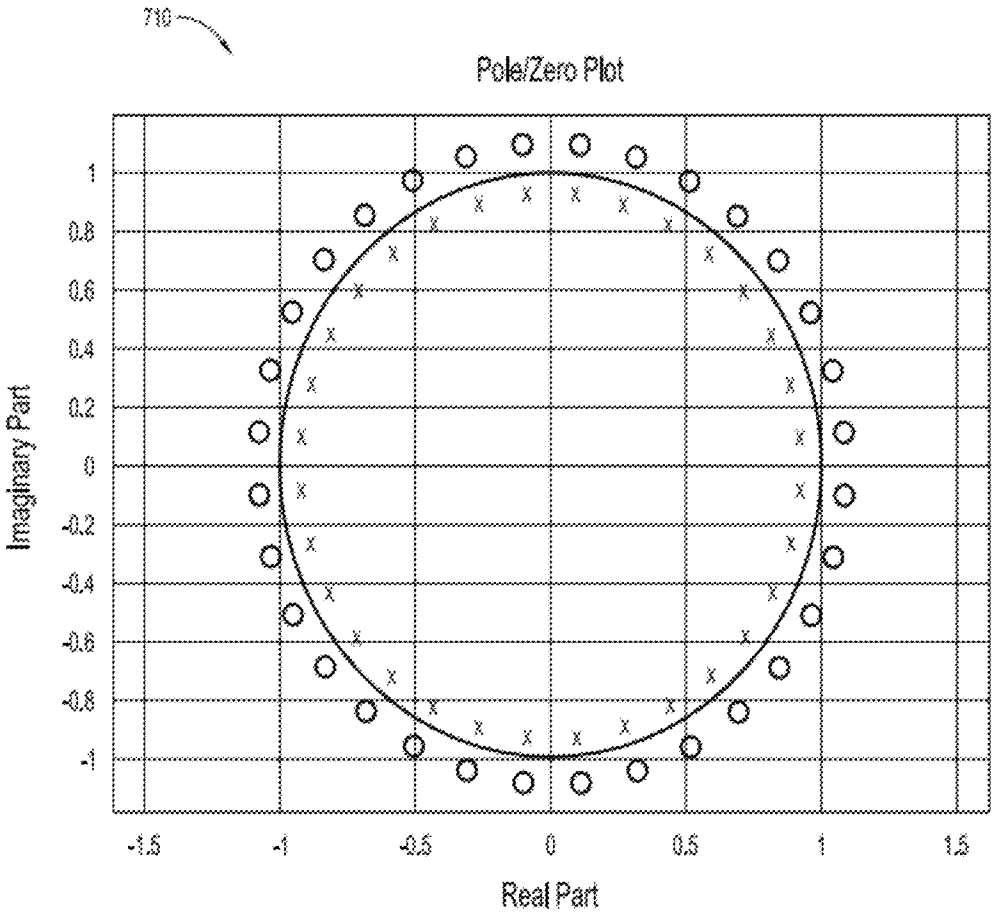
FIGS. 7A, 7B, 8A, and 8B illustrate example pole-zero and phase-delay plots associated with the example depth renderers depicted in FIGS. 6A and 6B.
Figure 7B:
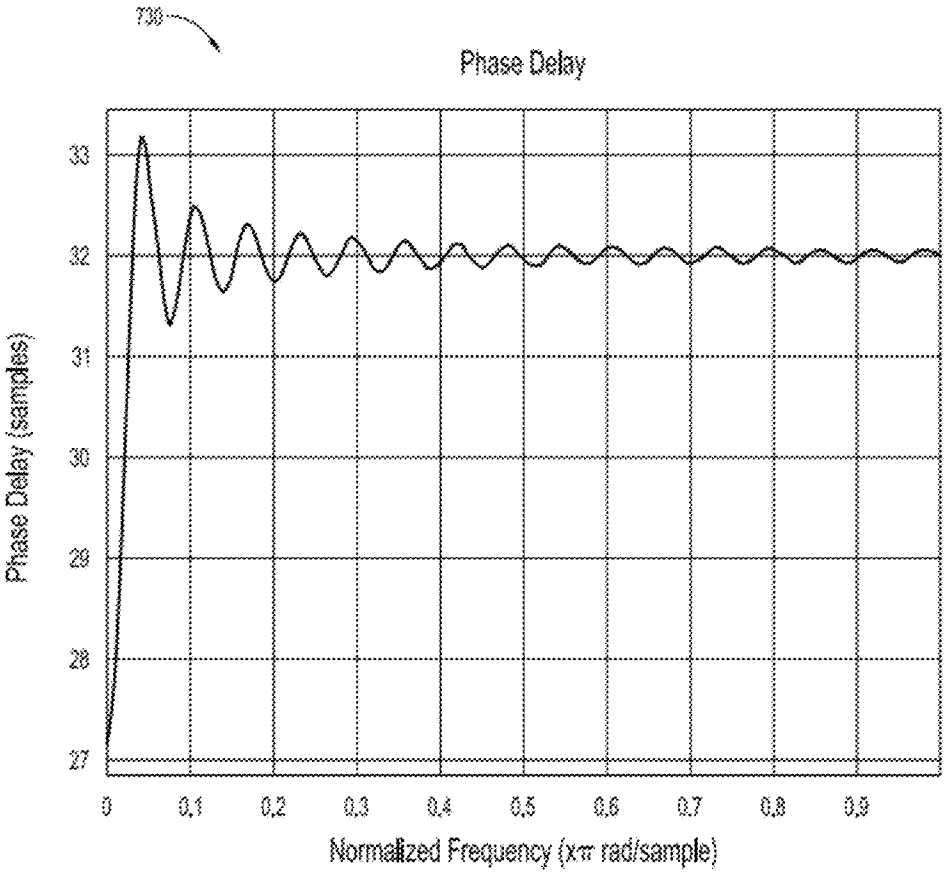

In certain embodiments, when the steering signal applied to the multiplier 602 is relatively large (e.g., >1), the depth rendering filter 630 becomes a maximum phase filter with all zeros outside of the unit circle, and a phase delay is introduced. An example of this maximum phase effect is illustrated in FIG. 7A, which shows a pole-zero plot 710 having zeros outside of the unit circle. A corresponding phase plot 730 is shown in FIG. 7B, showing an example delay of about 32 samples corresponding to a relatively large value of the multiplier 602 coefficient. Other delay values can be set by adjusting the value of the multiplier 602 coefficient.

Figure 8A:
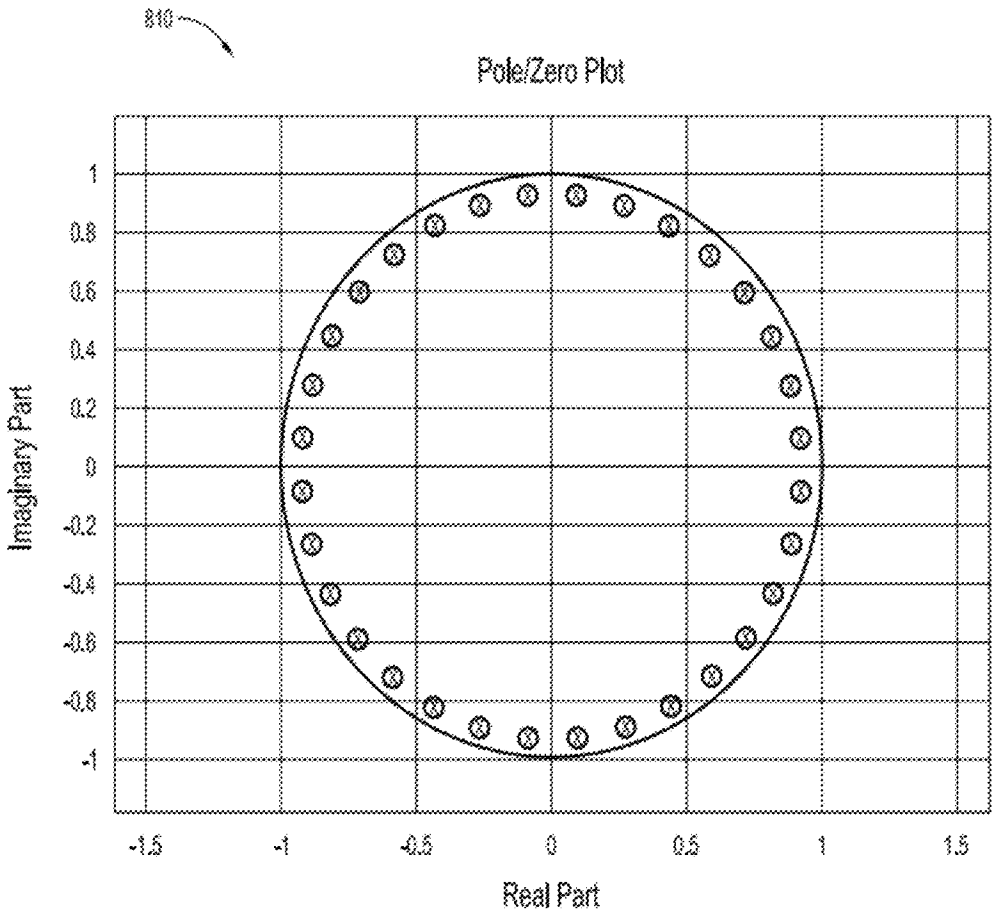
Figure 8B:
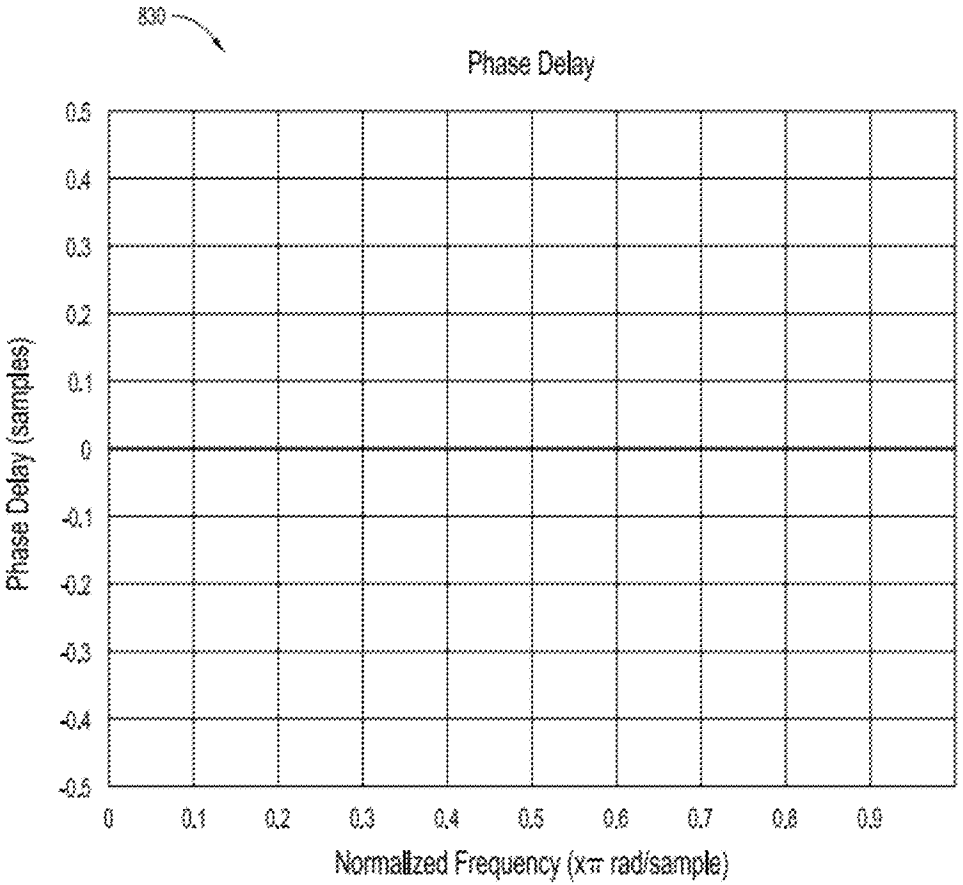

When the steering signal applied to the multiplier 602 is relatively smaller (e.g., <1), the depth rendering filter 630 becomes a minimum phase filter, with its zeros inside the unit circle. As a result, the phase delay is zero (or close to zero). An example of this minimum phase effect is illustrated in FIG. 8A, which shows a pole-zero plot 810 having all zeros inside the unit circle. A corresponding phase plot 830 is shown in FIG. 8B, showing a delay of 0 samples.

Figure 9:
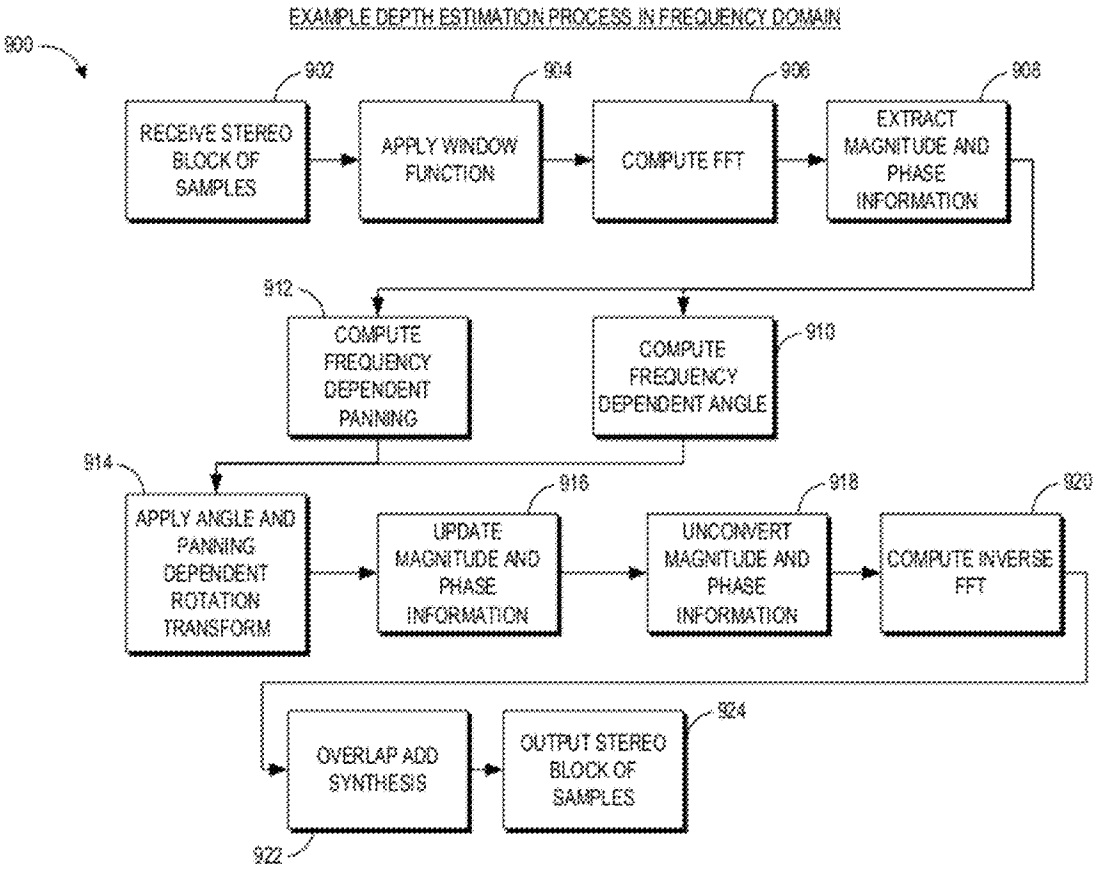
FIG. 9 illustrates an example frequency-domain depth estimation process.

FIG. 9 illustrates an example frequency-domain depth estimation process 900. The frequency-domain process 900 can be implemented by any of the systems 110, 310 described above and may be used in place of the time-domain filters described above with respect to FIGS. 6A through 8B. Thus, depth rendering can be performed in either the time domain or the frequency domain (or both).

In general, various frequency domain techniques can be used to render the left and right signals so as to emphasize depth. For example, the fast Fourier transform (FFT) can be calculated for each input signal. The phase of each FFT signal can then be adjusted to create phase differences between the signals. Similarly, intensity differences can be applied to the two FFT signals. An inverse-FFT can be applied to each signal to produce time-domain, rendered output signals.

Referring specifically to FIG. 9, at block 902, a stereo block of samples is received. The stereo block of samples can include left and right audio signals. A window function 904 is applied to the block of samples at block 904. Any suitable window function can be selected, such as a Hamming window or Hanning window. The Fast Fourier Transform (FFT) is computed for each channel at block 906 to produce a frequency domain signal, and magnitude and phase information are extracted at block 908 from each channel's frequency domain signal.

Phase delays for ITD effects can be accomplished in the frequency domain by changing the phase angle of the frequency domain signal. Similarly, magnitude changes for IID effects between the two channels can be accomplished by panning between the two channels. Thus, frequency dependent angles and panning are computed at blocks 910 and 912. These angles and panning gain values can be computed based at least in part on control signals output by the depth estimator 320 or 520. For example, a dominant control signal from the depth estimator 520 indicating that the left channel is dominant can cause the frequency dependent panning to calculate gains over a series of samples that will pan to the left channel. Likewise, the RMS(L−R)' signal or the like can be used to compute phase changes as reflected in the changing phase angles.

The phase angles and panning changes are applied to the frequency domain signals at block 914 using a rotation transform, for example, using polar complex phase shifts. Magnitude and phase information are updated in each signal at block 916. The magnitude and phase information are then unconverted from polar to Cartesian complex form at block 918 to enable inverse FFT processing. This unconversion step can be omitted in some embodiments, depending on the choice of FFT algorithm.

An inverse FFT is computed for each frequency domain signal at block 920 to produce time domain signals. The stereo sample block is then combined with a preceding stereo sample block using overlap-add synthesis at block 922 and then output at block 924.

III. Video Depth Estimation Embodiments

Figure 10B:
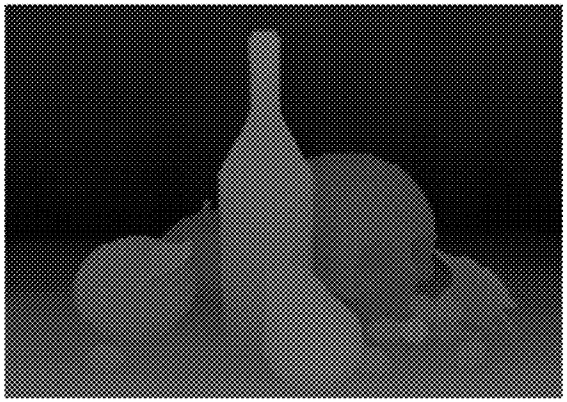
FIGS. 10A and 10B illustrate examples of video frames that can be used to estimate depth.
Figure 10A:
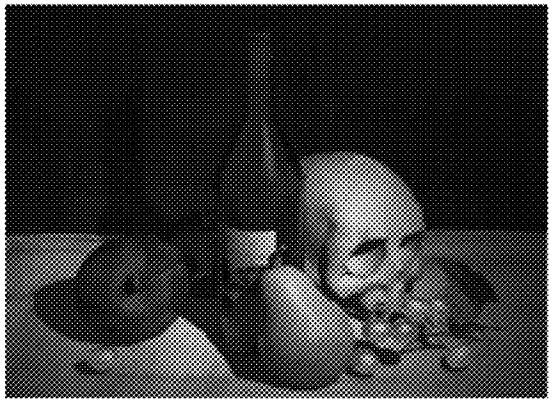

FIGS. 10A and 10B illustrate examples of video frames 1000 that can be used to estimate depth. In FIG. 10A, a video frame 1000A depicts a color scene from a video. A simplified scene has been selected to more conveniently illustrate depth mapping, although no audio is likely emitted from any of the objects in the particular video frame 1000A shown. Based on the color video frame 1000A, a grayscale depth map may be created using currently-available techniques, as shown in a grayscale frame 1000B in FIG. 10B. The intensity of the pixels in the grayscale image reflect the depth of the pixels in the image, with darker pixels reflecting greater depth and lighter pixels reflecting less depth (these conventions can be reversed).

For any given video, a depth estimator (e.g., 320) can obtain a grayscale depth map for one or more frames in the video and can provide an estimate of the depth in the frames to a depth renderer (e.g., 330). The depth renderer can render a depth effect in an audio signal that corresponds to the time in the video that a particular frame is shown, for which depth information has been obtained (see FIG. 11).

Figure 11:
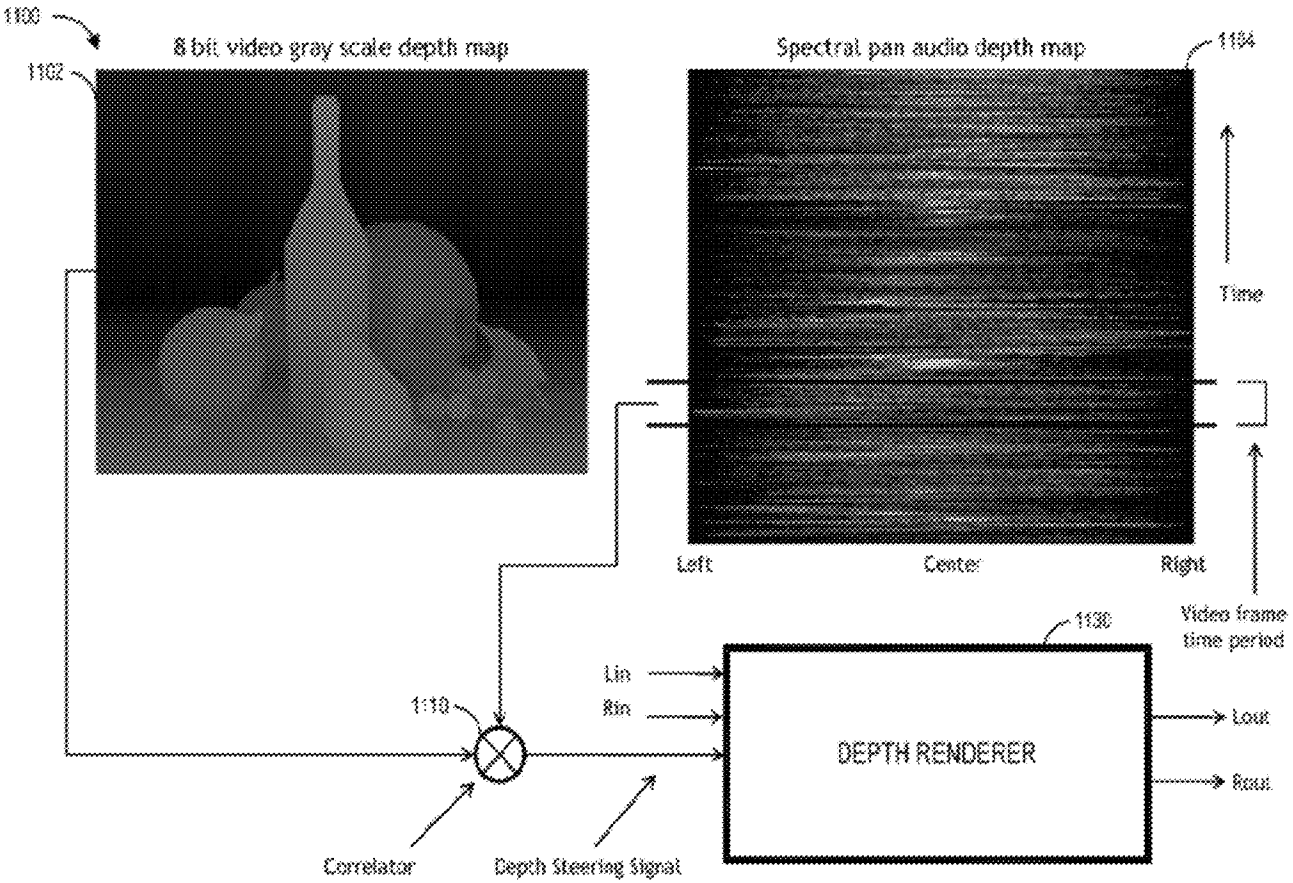
FIG. 11 illustrates an embodiment of a depth estimation and rendering algorithm that can be used to estimate depth from video data.

FIG. 11 illustrates an embodiment of a depth estimation and rendering algorithm 1100 that can be used to estimate depth from video data. The algorithm 1100 receives a grayscale depth map 1102 of a video frame and a spectral pan audio depth map 1104. An instant in time in the audio depth map 1104 can be selected which corresponds to the time at which the video frame is played. A correlator 1110 can combine depth information obtained from the grayscale depth map 1102 with depth information obtained from the spectral pan audio map (or L−R, L, and/or R signals). The output of this correlator 1110 can be one or more depth steering signals that control depth rendering by a depth renderer 1130 (or 330 or 630).

In certain embodiments, the depth estimator (not shown) can divide the grayscale depth map into regions, such as quadrants, halves, or the like. The depth estimator can then analyze pixel depths in the regions to determine which region is dominant. If a left region is dominant, for instance, the depth estimator can generate a steering signal that causes the depth renderer 1130 to emphasize left signals. The depth estimator can generate this steering signal in combination with the audio steering signal(s), as described above (see FIG. 5), or independently without using the audio signal.

Figure 12:
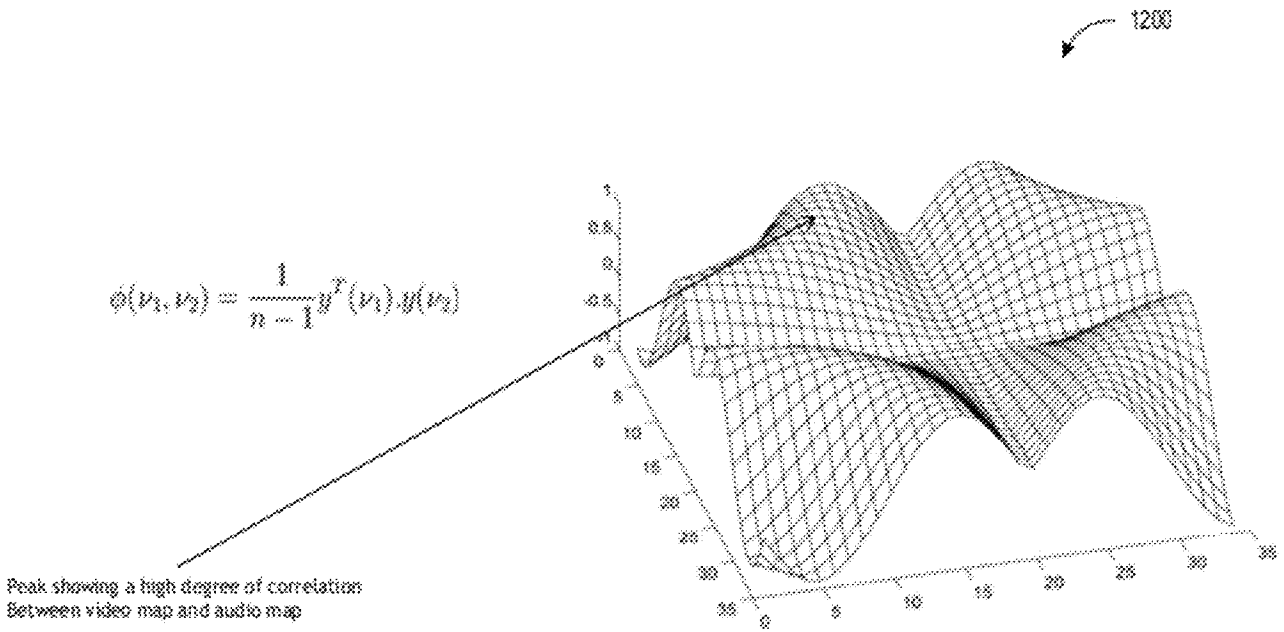
FIG. 12 illustrates an example analysis of depth based on video data.

FIG. 12 illustrates an example analysis plot 1200 of depth based on video data. In the plot 1200, peaks reflect correlation between the video and audio maps of FIG. 11. As the location of these peaks change over time, the depth estimator can decorrelate the audio signals correspondingly to emphasize the depth in the video and audio signals.

IV. Surround Processing Embodiments

As described above with respect to FIG. 3A, depth-rendered left and right signals are provided to an optional surround processing module 340*a*. As described above, the surround processor 340*a* can broaden the sound stage, thereby widening the sweet spot and increasing the sense of depth, using one or more perspective curves or the like described in U.S. Pat. No. 7,492,907, incorporated above.

In one embodiment, one of the control signals, the L−R signal (or a normalized envelope thereof), can be used to modulate the surround processing applied by the surround processing module (see FIG. 5). Because a greater magnitude of the L−R signal can reflect greater depth, more surround processing can be applied when L−R is relatively greater and less surround processing can be applied when L−R is relatively smaller. The surround processing can be adjusted by adjusting a gain value applied to the perspective curve(s). Adjusting the amount of surround processing applied can reduce the potentially adverse effects of applying too much surround processing when little depth is present in the audio signals.

FIGS. 13 through 16 illustrate embodiments of surround processors. FIGS. 17 and 18 illustrate embodiments of perspective curves that can be used by the surround processors to create a virtual surround effect.

Figure 13:
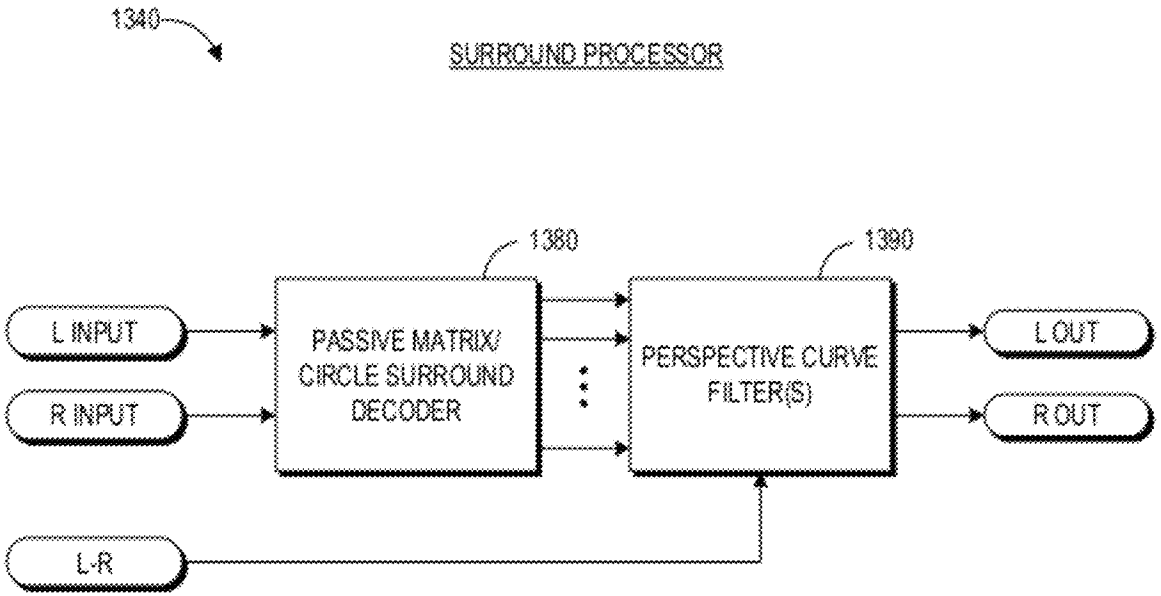
FIGS. 13 and 14 illustrate embodiments of surround processors.

Turning to FIG. 13, an embodiment of a surround processor 1340 is shown. The surround processor 1340 is a more detailed embodiment of the surround processor 340 described above. The surround processor 1340 includes a decoder 1380, which may be a passive matrix decoder, Circle Surround decoder (see U.S. Pat. No. 5,771,295, titled "5-2-5 Matrix System," the disclosure of which is hereby incorporated by reference in its entirety), or the like. The decoder 1380 can decode left and right input signals (received, e.g., from the depth renderer 330*a*) into multiple signals that can be surround-processed with perspective curve filter(s) 1390. In one embodiment, the output of the decoder 1380 includes left, right, center, and surround signals. The surround signals may include both left and right surround or simply a single surround signal. In one embodiment, the decoder 1380 synthesizes a center signal by summing L and R signals (L+R) and synthesizes a rear surround signal by subtracting R from L (L−R).

One or more perspective curve filter(s) 1390 can provide a spaciousness enhancement to the signals output by the decoder 1380, which can widen the sweet spot for the purposes of depth rendering, as described above. The spaciousness or perspective effect provided by these filter(s) 1390 can be modulated or adjusted based on L−R difference information, as shown. This L−R difference information may be processed L−R difference information according to the envelope, smoothing, and/or normalization effects described above with respect to FIG. 5.

In some embodiments, the surround effect provided by the surround processor 1340 can be used independently of depth rendering. Modulation of this surround effect by the difference information in the left and right signals can enhance the quality of the sound effect independent of depth rendering.

More information on perspective curves and surround processors are described in the following U.S. patents, which can be implemented in conjunction with the systems and methods described herein: U.S. Pat. No. 7,492,907, titled "Multi-Channel Audio Enhancement System For Use In Recording And Playback And Methods For Providing Same," U.S. Pat. No. 8,050,434, titled "Multi-Channel Audio Enhancement System," and U.S. Pat. No. 5,970,152, titled "Audio Enhancement System for Use in a Surround Sound Environment," the disclosures of each of which is hereby incorporated by reference in its entirety.

Figure 14:
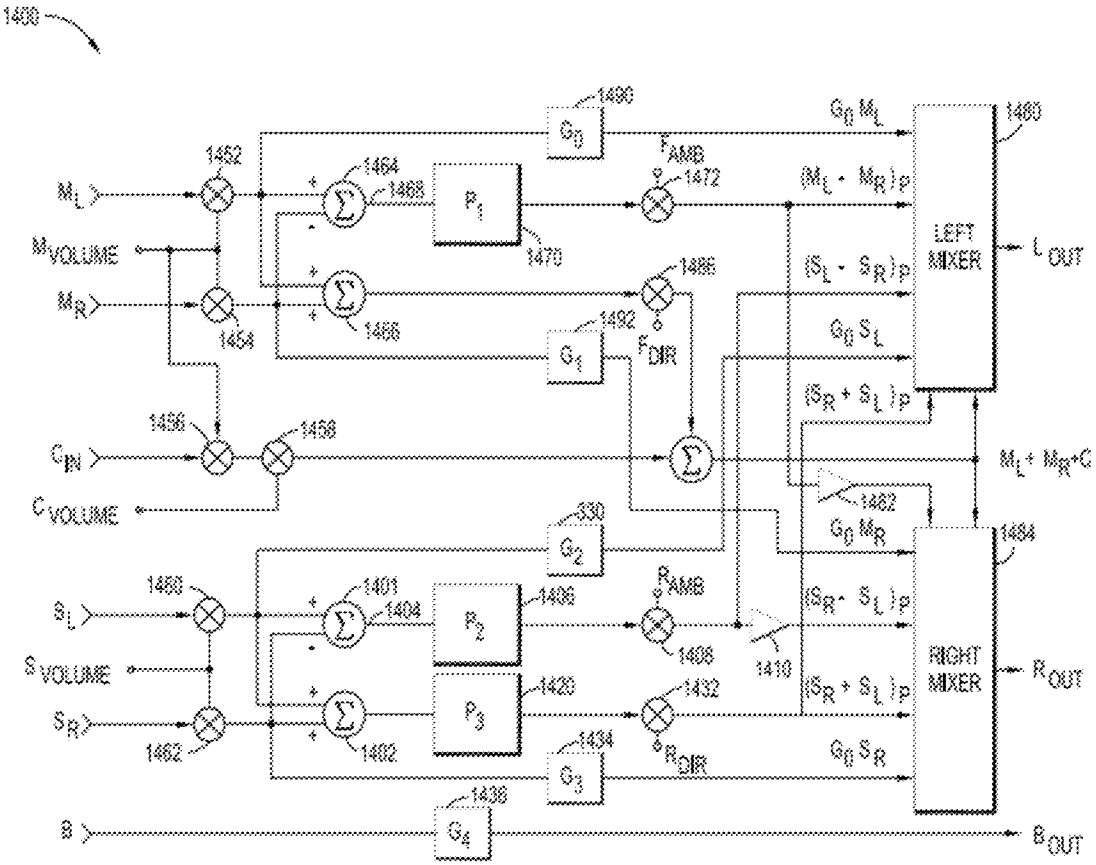

FIG. 14 illustrates a more detailed embodiment of a surround processor 1400. The surround processor 1400 can be used to implement any of the features of the surround processors described above, such as the surround processor 1340. For ease of illustration, no decoder is shown. Instead, audio inputs ML (left front), MR (right front), Center (CIN), optional subwoofer (B), left surround (SL), and right surround (SR) are provided to the surround processor 1400, which applies perspective curve filters 1470, 1406, and 1420 to various mixings of the audio inputs.

The signals ML and MR are fed to corresponding gain-adjusting multipliers 1452 and 1454 which are controlled by a volume adjustment signal Mvolume. The gain of the center signal C may be adjusted by a first multiplier 1456, controlled by the signal Mvolume, and a second multiplier 1458 controlled by a center adjustment signal Cvolume. Similarly, the surround signals SL and SR are first fed to respective multipliers 1460 and 1462 which are controlled by a volume adjustment signal Svolume.

The main front left and right signals, ML and MR, are each fed to summing junctions 1464 and 1466. The summing junction 1464 has an inverting input which receives MR and a non-inverting input which receives ML which combine to produce ML−MR along an output path 1468. The signal ML−MR is fed to a perspective curve filter 1470 which is characterized by a transfer function P1. A processed difference signal, (ML−MR)p, is delivered at an output of the perspective curve filter 1470 to a gain adjusting multiplier 1472. The gain adjusting multiplier 1472 can apply the surround scale 536 setting described above with respect to FIG. 5. As a result, the output of the perspective curve filter 1470 can be modulated based on the difference information in the L−R signal.

The output of the multiplier 1472 is fed directly to a left mixer 1480 and to an inverter 1482. The inverted difference signal (MR−ML)p is transmitted from the inverter 1482 to a right mixer 1484. A summation signal ML+MR exits the junction 1466 and is fed to a gain adjusting multiplier 1486. The gain adjusting multiplier 1486 may also apply the surround scale 536 setting described above with respect to FIG. 5 or some other gain setting.

The output of the multiplier 1486 is fed to a summing junction which adds the center channel signal, C, with the signal ML+MR. The combined signal, ML+MR+C, exits the junction 1490 and is directed to both the left mixer 1480 and the right mixer 1484. Finally, the original signals ML and MR are first fed through fixed gain adjustment components, e.g., amplifiers, 1490 and 1492, respectively, before transmission to the mixers 1480 and 1484.

The surround left and right signals, SL and SR, exit the multipliers 1460 and 1462, respectively, and are each fed to summing junctions 1400 and 1402. The summing junction 1401 has an inverting input which receives SR and a non-inverting input which receives SL which combine to produce SL-SR along an output path 1404. All of the summing junctions 1464, 1466, 1400, and 1402 may be configured as either an inverting amplifier or a non-inverting amplifier, depending on whether a sum or difference signal is generated. Both inverting and non-inverting amplifiers may be constructed from ordinary operational amplifiers in accordance with principles common to one of ordinary skill in the art. The signal SL−SR is fed to a perspective curve filter 1406 which is characterized by a transfer function P2.

A processed difference signal, (SL−SR)p, is delivered at an output of the perspective curve filter 1406 to a gain adjusting multiplier 1408. The gain adjusting multiplier 1408 can apply the surround scale 536 setting described above with respect to FIG. 5. This surround scale 536 setting may be the same or different than that applied by the multiplier 1472. In another embodiment, the multiplier 1408 is omitted or is dependent on a setting other than the surround scale 536 setting.

The output of the multiplier 1408 is fed directly to the left mixer 1480 and to an inverter 1410. The inverted difference signal (SR−SL)p is transmitted from the inverter 1410 to the right mixer 1484. A summation signal SL+SR exits the junction 1402 and is fed to a separate perspective curve filter 1420 which is characterized by a transfer function P3. A processed summation signal, (SL+SR)p, is delivered at an output of the perspective curve filter 1420 to a gain adjusting multiplier 1432. The gain adjusting multiplier 1432 can apply the surround scale 536 setting described above with respect to FIG. 5. This surround scale 536 setting may be the same or different than that applied by the multipliers 1472, 1408. In another embodiment, the multiplier 1432 is omitted or is dependent on a setting other than the surround scale 536 setting.

While reference is made to sum and difference signals, it should be noted that use of actual sum and difference signals is only representative. The same processing can be achieved regardless of how the ambient and monophonic components of a pair of signals are isolated. The output of the multiplier 1432 is fed directly to the left mixer 1480 and to the right mixer 1484. Also, the original signals SL and SR are first fed through fixed-gain amplifiers 1430 and 1434, respectively, before transmission to the mixers 1480 and 1484. Finally, the low-frequency effects channel, B, is fed through an amplifier 1436 to create the output low-frequency effects signal, BOUT. Optionally, the low frequency channel, B, may be mixed as part of the output signals, LOUT and ROUT, if no subwoofer is available.

Moreover, the perspective curve filter 1470, as well as the perspective curve filters 1406 and 1420, may employ a variety of audio enhancement techniques. For example, the perspective curve filters 1470, 1406, and 1420 may use time-delay techniques, phase-shift techniques, signal equalization, or a combination of all of these techniques to achieve a desired audio effect.

In an embodiment, the surround processor 1400 uniquely conditions a set of multi-channel signals to provide a surround sound experience through playback of the two output signals LOUT and ROUT. Specifically, the signals ML and MR are processed collectively by isolating the ambient information present in these signals. The ambient signal component represents the differences between a pair of audio signals. An ambient signal component derived from a pair of audio signals is therefore often referred to as the "difference" signal component. While the perspective curve filters 1470, 1406, and 1420 are shown and described as generating sum and difference signals, other embodiments of perspective curve filters 1470, 1406, and 1420 may not distinctly generate sum and difference signals at all.

In addition to processing of 5.1 surround audio signal sources, the surround processor 1400 can automatically process signal sources having fewer discrete audio channels. For example, if Dolby Pro-Logic signals or passive-matrix decoded signals (see FIG. 13) are input by the surround processor 1400, e.g., where SL=SR, only the perspective curve filter 1420 may operate in one embodiment to modify the rear channel signals since no ambient component will be generated at the junction 1400. Similarly, if only two-channel stereo signals, ML and MR, are present, then the surround processor 1400 operates to create a spatially enhanced listening experience from only two channels through operation of the perspective curve filter 1470.

Figure 15:
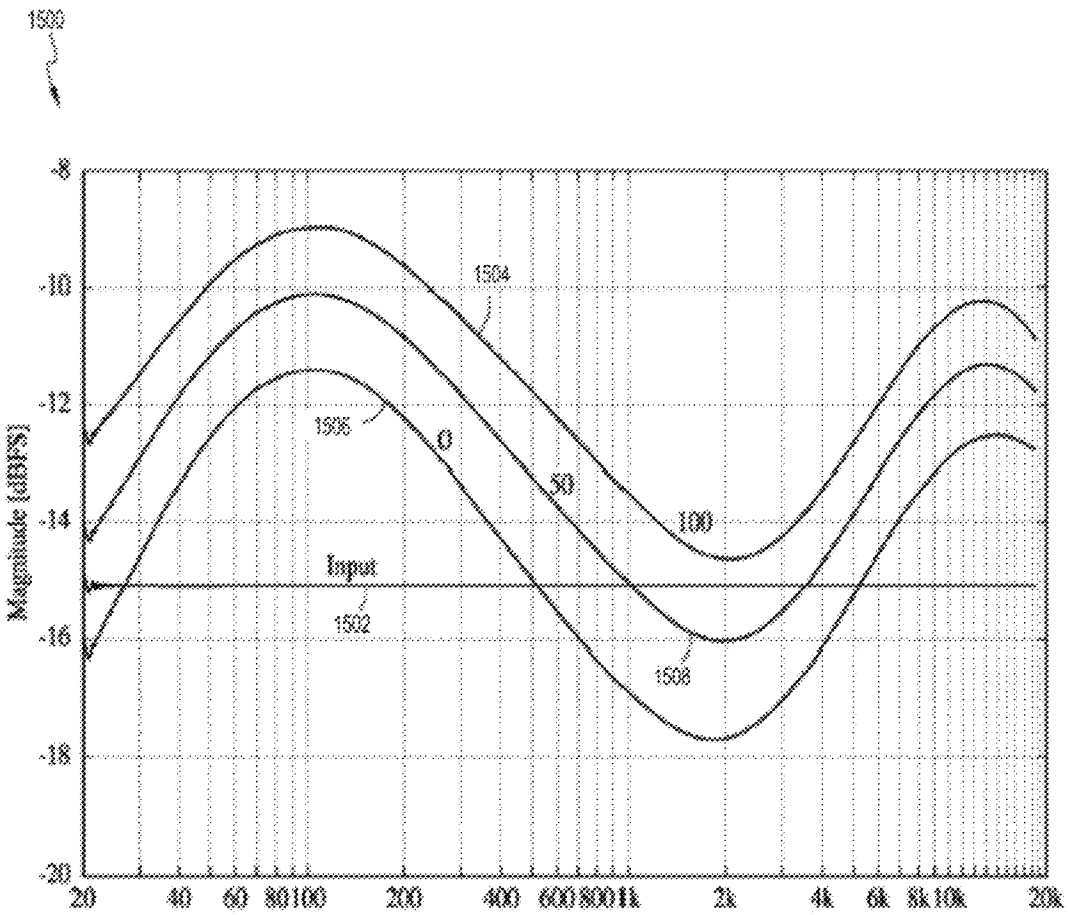
FIGS. 15 and 16 illustrate embodiments of perspective curves that can be used by the surround processors to create a virtual surround effect.

FIG. 15 illustrates example perspective curves 1500 that can be implemented by any of the surround processors described herein. These perspective curves 1500 are front perspective curves in one embodiment, which can be implemented by the perspective curve filter 1470 of FIG. 14. FIG. 15 depicts an input 1502, a −15 dBFSs log sweep and also depicts traces 1504, 1506, and 1508 that show example magnitude responses of a perspective curve filter over the displayed frequency range.

While the response shown by the traces in FIG. 15 are shown throughout the entire 20 Hz to 20 kHz frequency range, these response in certain embodiments need not be provided through the entire audible range. For example, in certain embodiments, certain of the frequency responses can be truncated to, for instance, a 40 Hz to 10 kHz range with little or no loss of functionality. Other ranges may also be provided for the frequency responses.

In certain embodiments, the traces 1504, 1506 and 1508 illustrate example frequency responses of one or more of the perspective filters described above, such as the front or (optionally) rear perspective filters. These traces 1504, 1506, 1508 represent different levels of the perspective curve filters based on the surround scale 536 setting of FIG. 5. A greater magnitude of the surround scale 536 setting can result in a greater magnitude curve (e.g., curve 1404), while lower magnitudes of the surround scale 536 setting can result in lower magnitude curves (e.g., 1406 or 1408). The actual magnitudes shown are merely examples only and can be varied. Further, more than three different magnitudes can be selected based on the surround scale value 536 in certain embodiments.

In more detail, the trace 1504 starts at about −16 dBFS at about 20 Hz, and increases to about −11 dBFS at about 100 Hz. Thereafter, the trace 1504 decreases to about −17.5 dBFS at about 2 kHz and thereafter increases to about −12.5 dBFS at about 15 kHz. The trace 1506 starts at about −14 dBFS at about 20 Hz, and it increases to about −10 dBFS at about 100 Hz, and decreases to about −16 dBFS at about 2 kHz, and increases to about −11 dBFS at about 15 kHz. The trace 1508 starts at about −12.5 dBFS at about 20 Hz, and increases to about −9 dBFS at about 100 Hz, and decreases to about −14.5 dBFS at about 2 kHz, and increases to about −10.2 dBFS at about 15 kHz.

As shown in the depicted embodiments of traces 1504, 1506, and 1508, frequencies in about the 2 kHz range are de-emphasized by the perspective filter, and frequencies at about 100 Hz and about 15 kHz are emphasized by the perspective filters. These frequencies may be varied in certain embodiments.

Figure 16:
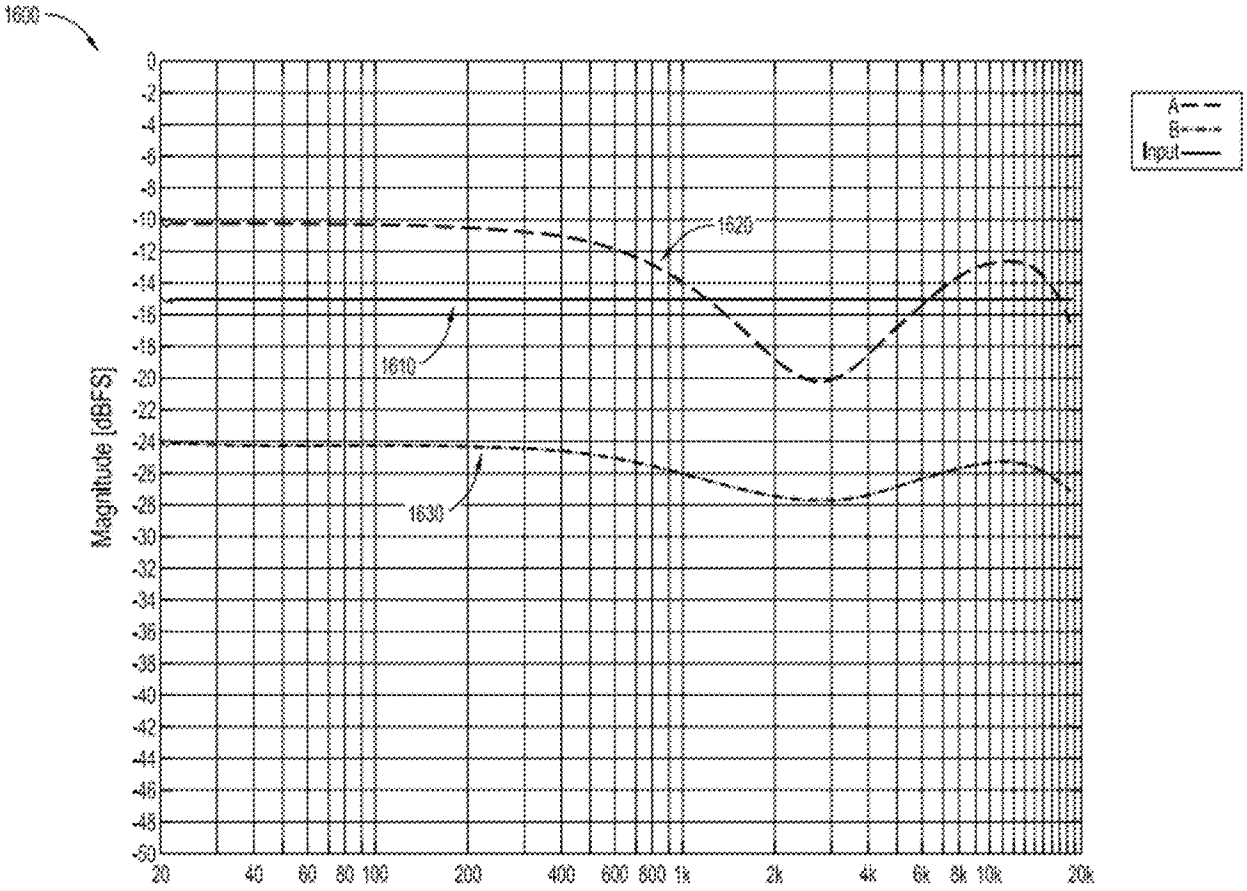

FIG. 16 illustrates another example of perspective curves 1600 that can be implemented by any of the surround processors described herein. These perspective curves 1600 are rear perspective curves in one embodiment, which can be implemented by the perspective curve filters 1406 or 1420 of FIG. 14. As in FIG. 15, an input log frequency sweep 1610 is shown, resulting in the output traces 1620, 1630 of two different perspective curve filters.

In one embodiment, the perspective curve 1620 corresponds to a perspective curve filter applied to a surround difference signal. For example, the perspective curve 1620 can be implemented by the perspective curve filter 1406. The perspective curve 1620 corresponds in certain embodiments to a perspective curve filter applied to a surround sum signal. For instance, the perspective curve 1630 can be implemented by the perspective curve filter 1420. Effective magnitudes of the curves 1620, 1630 can vary based on the surround scale 536 setting described above.

In more detail, in the example embodiment shown, the curve 1620 has an approximately flat gain at about −10 dBFS, which attenuates to a trough occurring between about 2 kHz and about 4 kHz, or at approximately between 2.5 kHz and 3 kHz. From this trough, the curve 1620 increases in magnitude until about 11 kHz, or between about 10 kHz and 12 kHz, where a peak occurs. After this peak, the curve 1620 attenuates again until about 20 kHz or less. The curve 1630 has a similar structure but with less pronounced peaks and troughs, with a flat curve until a trough at about 3 kHz (or between about 2 kHz and 4 khz), and a peak about 11 kHz (or between about 10 kHz and 12 kHz), with attenuation to about 20 kHz or less.

The curves shown are merely examples and can be varied in different embodiments. For example, a high pass filter can be combined with the curves to change the flat low-frequency response to an attenuating low-frequency response.

V. Terminology

Many other variations than those described herein will be apparent from this disclosure. For example, depending on the embodiment, certain acts, events, or functions of any of the algorithms described herein can be performed in a different sequence, can be added, merged, or left out all together (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the embodiments disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor may also include primarily analog components. For example, any of the signal processing algorithms described herein may be implemented in analog circuitry. A computing environment can include any type of computer system, including, but not limited to, a computer system based on a microprocessor, a mainframe computer, a digital signal processor, a portable computing device, a personal organizer, a device controller, and a computational engine within an appliance, to name a few.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of non-transitory computer-readable storage medium, media, or physical computer storage known in the art. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, certain embodiments of the inventions described herein can be embodied within a form that does not provide all of the features and benefits set forth herein, as some features can be used or practiced separately from others.

What is claimed is:

1. A method of rendering depth in an audio output signal, the method comprising:

receiving a plurality of audio signals;

identifying first depth steering information from the audio signals at a first time, the first depth steering information responsive to a first decorrelation of the audio signals;

applying nonlinear processing to the first depth steering information to produce second depth steering information, the nonlinear processing configured to accentuate a magnitude of the first depth steering information with a greater than linear increase that nonlinearly emphasizes the first decorrelation of the audio signals such that relatively faster changes in the magnitude of the first decorrelation are emphasized more than relatively slower changes in the magnitude of the first decorrelation;

identifying subsequent depth steering information from the audio signals at a second time;

decorrelating, by one or more processors, the plurality of audio signals by a first amount that depends at least partly on the second depth steering information to produce first decorrelated audio signals, wherein said decorrelating comprises applying greater decorrelation responsive to the second depth steering information being relatively higher and applying less decorrelation responsive to the second depth steering information being relatively lower;

outputting the first decorrelated audio signals for playback to a listener;

subsequent to said outputting, decorrelating the plurality of audio signals by a second amount different from the first amount, the second amount depending at least partly on the subsequent depth steering information to produce second decorrelated audio signals; and outputting the second decorrelated audio signals for playback to the listener.

2. The method of claim 1, wherein said decorrelating the plurality of audio signals by a first amount comprises dynamically adjusting one or both of a delay and a gain applied to the plurality of audio signals.

3. The method of claim 1, further comprising processing the first and second decorrelated audio signals with a surround enhancement to widen a sound image of the first and second decorrelated audio signals.

4. The method of claim 3, further comprising modulating an amount of the surround enhancement applied to the first and second decorrelated audio signals based at least in part on the second and subsequent depth steering information.

5. The method of claim 4, further comprising reducing backwave crosstalk in the first and second decorrelated audio signals.

6. A method of rendering depth in an audio output signal, the method comprising:

receiving a plurality of audio signals;

identifying first depth steering information associated with the audio signals, the first depth steering information changing over time;

applying nonlinear processing to the first depth steering information to produce second depth steering information, the nonlinear processing configured to accentuate a magnitude of the first depth steering information with a greater than linear increase that nonlinearly emphasizes the first decorrelation of the audio signals such that relatively faster changes in the magnitude of the first decorrelation are emphasized more than relatively slower changes in the magnitude of the first decorrelation;

decorrelating the plurality of audio signals dynamically over time by an amount that depends on the second depth steering information, such that a greater existing depth in the audio signals is emphasized relatively more and a lower existing depth in the audio signals is emphasized relatively less, to produce a plurality of decorrelated audio signals; and outputting the plurality of decorrelated audio signals for playback to a listener;

wherein at least said decorrelating is performed at least by electronic hardware.

7. The method of claim 6, wherein the plurality of audio signals comprise a left audio signal and a right audio signal.

8. The method of claim 7, wherein said identifying the first depth steering information comprises estimating the depth in the audio signals based at least partly on difference information between the left and right audio signals.

9. The method of claim 6, wherein said identifying the first depth steering information comprises estimating the depth in the audio signals based at least partly on video information associated with a video corresponding to the plurality of audio signals.

10. The method of claim 6, wherein the audio signals comprise object metadata comprising position information associated with audio objects.

11. The method of claim 10, wherein said identifying the first depth steering information comprises converting the position information of the audio objects into the depth steering information.

12. The method of claim 6, wherein said decorrelating the audio signals comprises introducing a dynamically changing delay into one or more of the audio signals, wherein the delay changes based on the first depth steering information.

13. The method of claim 12, wherein said decorrelating comprises increasing a first delay of a first one of the audio signals while simultaneously decreasing a second delay of a second one of the audio signals.

14. The method of claim 6, wherein said decorrelating the audio signals comprises applying a dynamically changing gain to one or more of the audio signals, wherein the gain changes based on the first depth steering signal.

15. The method of claim 14, wherein said decorrelating comprises increasing a first gain of a first one of the audio signals while simultaneously decreasing a second gain of a second one of the audio signals.

16. A system for rendering depth in an audio output signal, the system comprising:

a depth estimator configured to:

receive two or more audio signals and to identify depth information associated with the two or more audio signals, and apply nonlinear processing to the depth information to produce nonlinear depth information, the nonlinear processing configured to accentuate a magnitude of the depth information with a greater than linear increase; and a depth renderer comprising one or more processors, the depth renderer configured to decorrelate the two or more audio signals by an amount that depends on the nonlinear depth information, such that a greater existing depth in the two or more audio signals is emphasized relatively more and a lower existing depth in the two or more audio signals is emphasized relatively less, to produce a plurality of decorrelated audio signals, and output the plurality of decorrelated audio signals.

17. The system of claim 16, wherein the depth estimator is further configured to identify depth information from normalized difference information associated with the two or more audio signals.

18. The system of claim 16, wherein the depth estimator is further configured to identify depth information based at least partly on determining which of the two or more audio signals is dominant.

19. The system of claim 16, wherein the two or more audio signals comprise a front left audio signal, a front right audio signal, a left surround audio signal, and a right surround audio signal.

20. The system of claim 19, wherein the depth renderer produces the plurality of decorrelated audio signals by at least decorrelating the front left audio signal and the front right audio signal and separately decorrelating the left surround audio signal and the right surround audio signal.

21. The system of claim 16, wherein the depth renderer applies a depth rendering filter to the two or more audio signals, the depth rendering filter comprising a feed-forward component and a feedback component, and wherein the feedback component is configured to reduce a comb filter effect generated by the feed-forward component.

22. The system of claim 21, wherein the feedback component is further configured to eliminate the comb filter effect generated by the feed-forward component.

23. A method of rendering depth in an audio output signal, the method comprising:

receiving input audio comprising two or more audio signals;

estimating depth information associated with the input audio, the depth information changing over time, said estimating the depth information comprising calculating an amount of existing decorrelation between the two or more audio signals;

emphasizing the depth information to produce nonlinear depth information by at least nonlinearly accentuating a magnitude of the first depth stcering information with a greater than linear increase;

enhancing the audio dynamically based on the nonlinear depth information, by one or more processors, said enhancing varying dynamically based on variations in the nonlinear depth information over time, said enhancing comprising emphasizing the existing decorrelation between the two or more audio signals based in part on the amount of existing decorrelation; and outputting the enhanced audio.

* * * * *

UNITED STATES PATENT AND TRADEMARK OFFICE

CERTIFICATE OF CORRECTION

PATENT NO. : 9,088,858 B2
APPLICATION NO. : 13/342743
DATED : July 21, 2015
INVENTOR(S) : Alan D. Kraemer It is certified that error appears in the above-identified patent and that said Letters Patent is hereby corrected as shown below:

In The Drawings

Sheet 2 of 24 (FIG. 1B) at line 2, Change “saggital” to --sagittal--.

In The Specification

In column 5 at line 8, Change “saggital” to --sagittal--.

In column 11 at line 58, Change “a >1.” to --a>1.--.

In column 12 at line 46, Change “RMS( )” to --RMS( )'--.

In column 21 at line 65, Change “khz),” to --kHz),--.

In column 22 at line 12, Change “all together” to --altogether--.

In The Claims

In column 26 at line 34, In Claim 23, change “first depth stcering” to --depth--.

Signed and Sealed this
Twenty-second Day of March, 2016

Michelle K. Lee

Michelle K. Lee
*Director of the United States Patent and Trademark Office*